US010332703B2

(12) United States Patent
Aartsen

(10) Patent No.: US 10,332,703 B2
(45) Date of Patent: Jun. 25, 2019

(54) SAFETY SWITCH ASSEMBLY

(71) Applicant: E. Dold & Söhne KG, Furtwangen (DE)

(72) Inventor: Frank Arthur Aartsen, Titisee-Neustadt (DE)

(73) Assignee: E. Dold & Söhne KG, Furtwangen (DE)

( * ) Notice: Subject to any disclaimer, the term of this patent is extended or adjusted under 35 U.S.C. 154(b) by 0 days.

(21) Appl. No.: 15/544,446

(22) PCT Filed: Mar. 1, 2016

(86) PCT No.: PCT/EP2016/000350
§ 371 (c)(1),
(2) Date: Jul. 18, 2017

(87) PCT Pub. No.: WO2016/142041
PCT Pub. Date: Sep. 15, 2016

(65) Prior Publication Data

US 2017/0365425 A1 Dec. 21, 2017

(30) Foreign Application Priority Data

Mar. 6, 2015 (DE) ..... 10 2015 002 863

(51) Int. Cl.
*H01H 27/00* (2006.01)
*H01H 19/64* (2006.01)
(Continued)

(52) U.S. Cl.
CPC ..... *H01H 27/002* (2013.01); *H01H 3/42* (2013.01); *H01H 19/64* (2013.01); *H01H 27/06* (2013.01); *H01H 2027/005* (2013.01)

(58) Field of Classification Search
CPC ..... H01H 27/002; H01H 27/06; H01H 3/42; H01H 19/64; H01H 2027/005
(Continued)

(56) References Cited

U.S. PATENT DOCUMENTS 4,658,102 A 4/1987 Seim et al.
5,420,385 A * 5/1995 Cooper ..... H01H 27/002 200/302.3
(Continued)

FOREIGN PATENT DOCUMENTS

CN 102150230 8/2011
DE 4134083 7/1993
(Continued)

*Primary Examiner* — Edwin A. Leon
*Assistant Examiner* — Lheiren Mae A Caroc
(74) *Attorney, Agent, or Firm* — Volpe and Koenig, P.C.

(57) ABSTRACT

The invention relates to a safety switch assembly (100) having a switch installation (120) having at least one switching member (12) and at least one actuation installation (110) having at least one assigned actuator (13, 13', 13", 14), wherein a transmission installation (130) having at least one transmission member (135) which is coupleable or coupled to the switching member (12, 12*a*), on the one hand, and to the at least one actuator (13, 13', 13", 14), on the other hand is provided between the actuation installation (110) and the switch installation (120). In order to have available a safety switch assembly (100) in which a mechanical fault does not lead to a failure of that functionality that optionally permits the integration of a diagnostic function in order for the system in the case of a fault being detected to be able to be brought back to a safe state and that permits a transfer of mechanical as well as of electrical/electronic functions across the entire system, it is provided that the transmission installation (120) is provided with a plurality of separate transmission members (135) which in the actuation of the at least one actuator (13, 13', 13", 14) of the actuation instal-
(Continued)

lation (110) are drivable or driven in a synchronous and mutually independent manner, and that each of the transmission members (135) by way of a rotary movement is permitted to convert an actuation movement of the at least one actuator (13, 13', 13", 14) to a translatory movement of in each case one separate switching member (12, 12*a*) of the switch installation (120). (FIG. 4).

35 Claims, 22 Drawing Sheets

(51) Int. Cl.
*H01H 3/42* (2006.01)
*H01H 27/06* (2006.01)

(58) Field of Classification Search
USPC ..... 200/43.04–43.08, 50.32
See application file for complete search history.

(56) References Cited

U.S. PATENT DOCUMENTS

| | | | | |
|---|---|---|---|---|
| 5,821,484 | A | 10/1998 | Schulze et al. | |
| 5,898,143 | A * | 4/1999 | Da Dalt ..... | H01H 27/002 200/17 R |
| 2003/0140669 | A1 | 7/2003 | Bailey et al. | |
| 2011/0127147 | A1 | 6/2011 | Konig et al. | |

FOREIGN PATENT DOCUMENTS

| | | |
|---|---|---|
| DE | 4328296 | 11/1994 |
| DE | 102005015797 | 10/2005 |
| DE | 102006006949 | 8/2007 |
| DE | 102009053717 | 5/2011 |
| DE | 102011121235 | 6/2013 |
| DE | 102012018080 | 3/2014 |
| EP | 1489694 | 12/2004 |
| GB | 2305964 | 4/1997 |
| WO | 2007093268 | 8/2007 |

* cited by examiner

SAFETY SWITCH ASSEMBLY

BACKGROUND

The invention relates to a safety switch assembly having a switch installation having at least one switching member and at least one actuation installation having an assigned actuator, wherein a transmission installation having at least one transmission member which is coupleable or coupled to the switching member, on the one hand, and to the at least one actuator, on the other hand, is provided between the actuation installation and the switch installation.

Switch and key transfer systems are employed as safety installations in industrial production facilities. Said switch and key transfer systems serve as a protection for operators who operate dangerous machinery. Said switch and key transfer systems thus are a safety installation for at least one isolating protective installation or blockage installation, or a device for monitoring the state of a protective installation of a machine or a plant, in particular key transfer systems, safety switches, or hybrids derived therefrom or the like, for monitoring the safe state of machines, plants, or the like.

Such systems are known in principle, and are commonly used in the case of safety switches. The design of safety switches herein is based on various concepts in terms of functionality, application and set-up potentials of the safety level to be achieved and in terms of the effort to be invested. First, electromechanical locking mechanisms which are constructed in a single-channel and thus in such a simple manner such that any fault arising rapidly leads to a malfunction or to a loss in functionality are thus known in the prior art for instance from U.S. Pat. No. 5,821,484 A, CN 102150230 A, GB 2305964 A, and U.S. Pat. No. 4,658,102 A, which is why a plurality of locking mechanisms of this type are often installed in machines and plants having an increased risk potential. An actuation element of an electromechanical locking mechanism that is constructed from two parts is known for instance from DE 102 009 053 717 A1, said electromechanical locking mechanism however by virtue of the still single-channel structure thereof not representing any improvement at this point.

In order for this disadvantage to be alleviated, the safety switches can also be provided with electronic locking mechanisms. On account thereof, individual faults become capable of being diagnosed, but a type of wiring which renders the respective systems sensitive to environmental influences is required to this end; however, these systems can be readily combined with command stations and interfaces with HMI functions.

A mechanical locking system as a key transfer system which by virtue of the conception thereof does not provide/require any wiring but in terms of the coupling of the elements thereof is again constructed in a single-channel manner is known from patent document US 2003/140669 A1. At this point, the potential for integrating further functions such as command buttons and/or HMI interfaces is missing.

EP 1489694 A1 discloses a key transfer system that is constructed from modules and combined with an electronic system. Despite the potential for integrating command functions, the system in mechanical terms is again structured in a single-channel manner. The modules therein by virtue of the construction thereof are not alignable in an arbitrary manner and prevent a transfer of electrical or electronic command functions across mechanical modules. Moreover, said modules are susceptible to faulty sealing and to this extent sensitive to ingress of water into the modules, as such ingress can lead to short circuits. Moreover, electrical connections of the system are sensitive to stress by way of bending moments.

EP 1 984 932 A1 discloses a modular mechanical key transfer system which is combined with the functional capabilities of electrical locking mechanisms. This system herein is capable of diagnosing individual faults in the mechanical train thereof; however problems in transferring electrical or electronic functions so as to bypass mechanical modules arise here too, such that these functional capabilities in modules are to be disposed on one side above or below mechanical units. Moreover, a transmission of force that is subject to improvement complicates any miniaturization of the internal gearbox therein.

Finally, a possibility for directing electrical or electronic functions as signals so as to bypass mechanical functions or modules in the sense of an external conduit is known from DE 10 2011 121 235 A1, this being sensitive to interruptions, on the one hand, and also susceptible to potential manipulations in an undesirable manner.

SUMMARY

There is therefore the object of providing a key transfer switch system which avoids the disadvantages that arise in the prior art and in the case of which a mechanical fault does not lead to a failure of that functionality that optionally permits the integration of a diagnostics function in order for the system in the case of a fault being detected to be able to be brought back to a safe state and that permits a transfer of mechanical as well as of electrical/electronic functions across the entire system.

This object is achieved by a key transfer switch system of the type mentioned at the outset, in which the transmission installation is provided with a plurality of separate transmission members which in the actuation of the actuator of the actuation installation are drivable or driven in a synchronous manner, and in that each of the transmission members by way of a rotary movement converts an actuation movement of the at least one actuator to a translatory movement of at least in each case one separate switching member of the switch installation. Thus, in this conversion, the respective switching member can be forcibly guided, in particular forcibly driven by the associated transmission member.

In the case of a safety switch assembly that is optionally of modular construction, the entire mechanical drive train is accordingly constructed having a plurality of transmission members which in a synchronously driven manner by way of a rotary movement convert a force that is exerted by the actuator back to a translatory movement, wherein each transmission member is now assigned at least one switching member which is capable of in turn transferring this translatory movement. Accordingly, the transmission installation and the switch installation on the safety switch installation form a type of fixed gearbox which by way of the multichannel structure thereof has an enhanced fail-safe reliability in terms of mechanical failure.

Optionally further reinforce A1, for example by means of the object, optionally by way of "further advantages and features of the invention are derived by means of the dependent claims (cf. Euchner).

In the case of one embodiment of the safety switch assembly according to the invention, which converts the translatory movement of the actuator that is carried out at the input end of the drive train in an appropriate manner to a likewise movement of the switching members, the transmission members of the transmission installation are expediently provided with a plurality of transmission elements.

Herein, one advantageous refinement which is capable of transferring the rotary movement of transmission elements to switching members of the assembly can be configured in such a manner that at least two transmission elements of in each case one transmission member of the transmission installation are interconnected in a rotationally fixed manner. For example, a transmission element on the respective drive train that faces away from the actuator herein can drive a switching member.

In order for the translatory movement of the actuator herein to initially be converted in a suitable manner to a rotary movement, in the case of one embodiment of the safety switch assembly in each case at least one transmission element of the transmission members is mounted so as to be pivotable about axes that extend between housing walls of a housing or part-housing of the safety switch assembly, said axes in particular being disposed so as to be mutually parallel.

As can be seen, one actuation portion of an actuator, one transmission member having a plurality of transmission elements, and one or a plurality of switching members on the safety switch assembly can quasi form one of a plurality of drive trains on the safety switch assembly.

In order for the plurality of switching members to carry out a translatory movement that has the same effective direction on the take-off side of the transmission members, in the case of one expedient embodiment of the safety switch assembly two transmission members of the transmission installation in the actuation of the actuator carry out a mutually opposing pivoting movement.

In order for the movement of the switching members of the safety switch assembly to be triggered, various types of movement are conceivable on the part of the actuator or actuators employed. In the case of one expedient embodiment of the safety switch assembly, the at least one actuator of the actuation installation when carrying out the actuation movement thereof can carry out a translatory or a rotary movement, for instance. In principle, a combination of such movements would also be conceivable herein, for example.

In the case of one advantageous refinement of the safety switch assembly according to the invention, the transmission of the actuation movement of the at least one actuator can be established in that the at least one actuator of the actuation installation is expediently assigned at least one gearbox part which is operatively connected to at least one first transmission element of a transmission member of the transmission installation.

In preferred refinements for transmitting the actuation movement, the respective gearbox part can be configured as an actuator portion that in each case is disposed in the region of a free end of the actuator, or as a cam gear, for instance. However, other configurations are also conceivable.

In the case of one expedient embodiment of the safety switch assembly, the cam gear transmits a rotary movement of the actuator to the transmission members, for instance. The cam gear herein can preferably be configured having at least one dog that engages in a respective entrainment opening, or can is configured having at least one gear drive. Other embodiments of the cam gear can also transmit the movement.

Synchronous driving of the switching members on the drive train mentioned can be achieved for example in that transmission elements of various transmission members have a mutual offset in a direction of actuation of the actuator. This applies in particular to translatory movements of an actuator. In this way, various portions that are disposed on an actuator in the actuation of said actuator can transmit the same movement to various trains in a synchronous manner, for instance.

In order for the transmission members of the transmission installation to be able to be driven, it can be provided in the case of one advantageous refinement of the safety switch assembly that a first transmission element of the transmission members in each case forms an interference fit for in each case one portion of the actuator, the introduction thereof into the interference fit or the retrieval thereof from the latter causing a rotary movement of the transmission element.

Preferably the first transmission element of the transmission members herein can in each case be configured in a roller-type manner, for instance, and have a cross section that is curved so as to be approximately crescent-shaped.

A utilization of force that is simple because it saves force in the actuation of the actuator is achieved by an embodiment of the safety switch assembly in which the actuation portions of the actuator that are provided for engaging in the interference fit of first transmission elements have a shaping that is complementary to an engagement portion of the first transmission element. Ideally, a form-fit and force-fit of the mutually engaging portions arises approximately on this engagement portion.

The safety switch assembly according to the invention in the case of one embodiment can be safeguarded against unintentional actuation and also against undesirable manipulation in that faces of the first transmission element and of the assigned actuation portion of the respective actuator that in a closed position are mutually facing are provided with a mutually matching coding, in particular from protrusions and depressions. The coding of the actuation portions herein has a function like the web of a key, wherein other forms of coding are also possible and conceivable, for example the width of the portions transverse to the direction of actuation.

For a reliable transmission of the moments of the pivoting movement of the transmission members, that is to say of the rotary proportion of the movement, to yet again a translatory movement of the switching members, in the case of one further embodiment of the safety switch assembly a second transmission element of a transmission member that is connected to the first transmission element can in each case be provided as an eccentric which engages in a receptacle of the switching member assigned to said second transmission element. Thus, an eccentric that is connected to the first transmission element in a rotationally fixed manner and by way of which the pivoting movement of the first transmission element that is caused by the actuation of the actuator causes a translatory movement of the switching member to which said eccentric is operatively connected, can thus be assigned to each first transmission element as a second transmission element of the respective transmission member. This operative connection according to the invention can thus be designed in particular in the form of a forcible guiding. It is obvious to a person skilled in the art herein that such a forcible guiding can always be subject to a certain clearance between the mechanical parts. A forcible guiding in the exemplary embodiment discussed herein can be understood to be that the position of the respective switching member is unequivocally defined by the position of the associated transmission member. The second transmission element of the transmission member in the form of an eccentric can thus guide the switching member. The switching member in particular can thus be forcibly drivable or driven, respectively, by the transmission member.

A space-saving construction of the safety switch assembly that is readily manageable is achieved by an embodiment in which the switch installation and the actuation installation and optionally further actuation installations or like functional installations are configured as modules, and in each case have connectors for releasably connecting to one another, and in each case switching members that in the assembly position are aligned and by way of one or a plurality of switching means acting between modules are releasably connectable to one another.

Expedient refinements of the safety switch assembly can have various embodiments of switching members which advantageously can be configured as planar plate-type switching pieces which in the translatory movement of the latter are in each case guided in at least one guide on the safety switch assembly. This guide can be composed of a groove of the housing wall of a module, for instance. In a further configuration herein, the guide can be provided in a wall-proximate region of a housing wall which is oriented so as to be transverse to the housing wall previously mentioned such that the switching members are oriented so as to be substantially parallel with this housing wall and are movable along the latter.

For transferring the movement that is triggered by actuating the actuator, in the case of one refinement of the safety switch assembly the switching members on at least one end thereof in the direction of movement can have at least one switching means in order for a connection to the switching means of a switching member that is neighboring in the direction of movement to be established or severed. It is conceivable herein that switching means in this way transmit both between switching members that are located within the same module as well as across modules. These switching means can also be disposed on both ends of the respective switching member, particularly when the module is not peripheral. Preferably, the switching means herein can in each case be configured as switching protrusions which from the respective switching member protrude substantially in the direction of a switching member that is neighboring in the respective direction of movement. In the movement toward the neighboring switching member, said switching means preferably contact the switching means of said neighboring switching member that again is provided in the form of switching protrusions disposed in a mirror-image manner. The switching means can also be of a different configuration.

In order for a failure of one of the drive trains of the safety switch assembly to be able to be reliably detected, in the case of one advantageous refinement of the assembly a sensor installation having at least one position sensor is disposed between two switching members of the switch installation that are disposed so as to be mutually parallel, said sensor installation determining the mutual relative position of the two switching members. The sensor installation herein primarily detects the situation as to whether the two switching members move (or can be moved) in a mutually synchronous manner. Preferably, a configuration of the position sensor of the sensor installation can in a linear manner connect two sensor regions that are disposed in a mirror-image in relation to an imaginary central plane between the switching members.

The position sensor herein can advantageously be provided with a connection web that extends between the sensor regions and is connected to said sensor regions in each case in an articulated manner, and with at least one blocking means. The connection web in the use position herein, in which the connected and mutually opposite sensor regions of the switching members move in a synchronous manner, extends therebetween in a manner such that the connection web projects approximately transversely from the sensor regions, for example. This angular position is then modified in a mutually asynchronous movement of the switching members. Other types of position sensors which are not necessarily of a mechanical configuration are also readily conceivable. In one preferred embodiment, the at least one blocking means can be formed by arms that project from the connection web substantially in the direction of the connection or transversely to the latter.

A suitable manner for precluding the further mutually asynchronous movement of the switching members herein is formed by a refinement of the safety switch assembly in which the blocking means of the position sensor in a modification of the mutual relative position of the switching members moves to an interference fit with an assigned blocking piece. The respective interference fit herein is caused by the approximately right angle that is no longer adhered to at this point between the connection web and the sensor regions. The blocking piece herein can preferably be disposed on at least one housing wall of the respective module, said at least one housing wall being neighboring to the switching members or extending between the switching members. The blocking piece herein can be formed by a region of the respective housing wall per se, for example.

One embodiment of the blocking piece that is easy to implement can be implemented by an advantageous embodiment of the assembly in which the blocking piece is formed by a plurality of groove-type interference fits that in the direction of actuation of the switching members are disposed beside one another so as to be mutually adjacent. These groove-type interference fits that are disposed beside one another can again be a component part of the afore-mentioned housing wall.

The availability of additional space on the modules of the assembly can be advantageous for establishing additional functions, for example of the electrical or electronic type, for which reason in the case of one expedient embodiment of said assembly an available space that is free of movable or moving transmission and/or switching members and extends in a contiguous manner across the entire longitudinal extent of the module running in the direction of movement of the switching members is provided between two opposite switching members of a module that are disposed so as to be mutually spaced apart. A plurality of moving switching members, in particular two moving switching members, herein can frame the respective available space, for example. If the switching members are formed by disk-type or plate-type switching pieces, the latter frame this available space approximately on two opposite sides. The available space mentioned herein can extend across a plurality of modules, in particular however also across all modules that are disposed beside one another such that a module-encompassing channel which can be utilized for example for transferring electrical signals across an encapsulated non-sensitive electrical train which is disposed in the available space or the channel, respectively, results from the lining-up of available spaces on the safety switch assembly.

In particular when a plurality of modules are provided for the assembly, it can be advantageous for a fundamentally arbitrary construction of the assembly from a plurality of modules for the contiguous space to be disposed about a central longitudinal axis of the module that is located between two switching members such that, on account thereof, no preferred direction that restricts the use is predefined.

At least one electrical and/or electronic signal transmission installation can herein advantageously be disposable or disposed in the available space that is located between the switching members of a module, such that the space made available on account thereof on the assembly is utilized for allocating additional functions to one or a plurality of modules.

Joining of modules in order for an assembly according to the invention to be formed is facilitated by one refinement in which a plurality of modules of the safety switch assembly are provided with connectors which are configured for assembly in various rotary positions of the modules, preferably at least in two assembly positions that are mutually rotated by approximately 90°. To this end, the modules preferably on the connector sides thereof can have moldings that engage in one another in a form-fitting manner, and a protrusion that deviates from a round shape, in particular a polygonal protrusion, can preferably be provided on one module, and a depression that is complementary to the protrusion can be provided on a module to be coupled.

In the case of one advantageous design embodiment of the invention it can be provided that the switching member in the safety switch assembly is forcibly guided by a transmission member. Such forcible guiding is particularly readily implementable for example in that a transmission element of the at least one transmission member that forcibly guides the switching member is configured in the form of an eccentric. This eccentric can engage in a matching interference fit of the switching member and thus implement form-fitting forcible guiding. By way of such forcible guiding it is avoidable, for example, that a switching member and the mechanical channel thus defined are in a non-defined state. It is thus in particular avoidable by way of such forcible guiding that the actuator can be retrieved from the safety switch assembly despite a switching member not being in the position that is envisaged for this state. By way of forcible guiding it is advantageous in the same manner that canting of the switching member is detectable directly on the actuator. A higher safety classification of the safety switch assembly is thus achievable overall by using such forcible guiding according to the invention.

Further advantageous features and properties of the safety switch assembly are derived from the dependent claims.

In one particularly preferred embodiment of the invention, the afore-described safety switch assembly forms a key transfer system, for example. Moreover, the safety switch assembly according to the invention by way of the functions thereof can also be used in the case of other systems, for example in the case of guard controls, motion switches that operate in a non-contacting manner, or in modules which process command functions or form human-machine interfaces, or in like modules more. Apart from actuator modules in various embodiments and switch modules, guard control modules having at least one actuator and having one locking system can also be provided. Moreover, the actuator modules can have a plurality of introduction openings of various orientations for actuators, keys, or the like; the modules moreover can have housings with assembly bores for attaching to a door post or a like support part, for example, or to be provided with assembly parts which make available this functional capability.

BRIEF DESCRIPTION OF THE DRAWINGS

The invention will be explained in more detail hereunder by means of exemplary embodiments in the drawing. In the drawing and in part in a schematic manner.

DETAILED DESCRIPTION OF THE PREFERRED EMBODIMENTS

Figure 2:
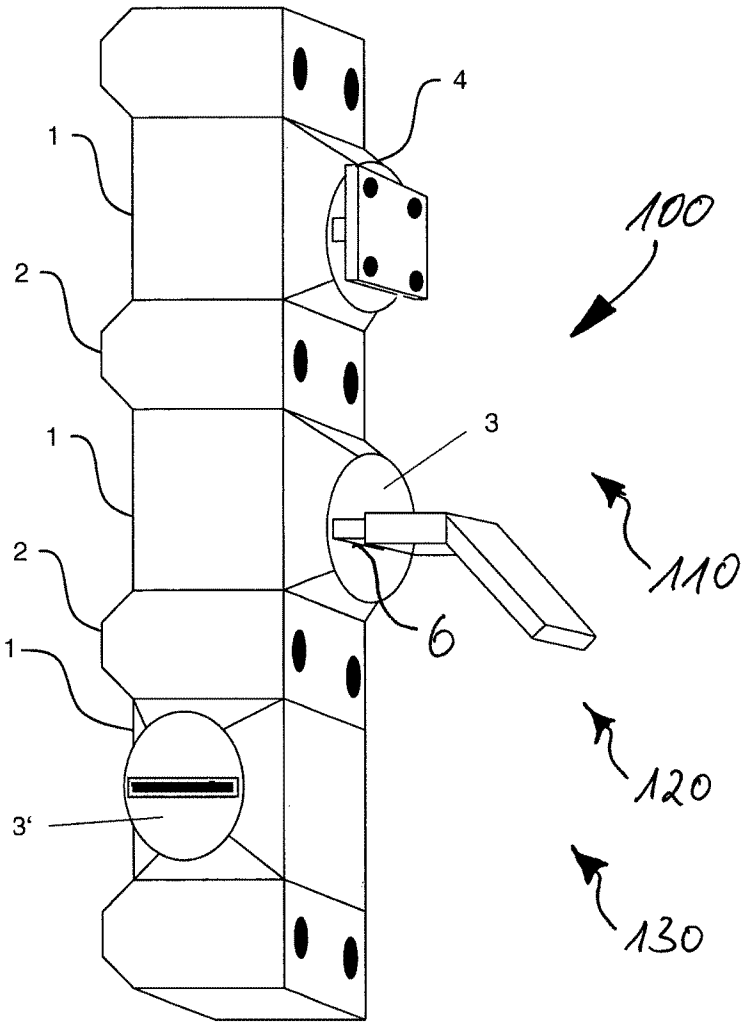
FIGS. 1, 2 show a first exemplary embodiment of the safety switch assembly according to the invention, having a plurality of modules.
Figure 1:
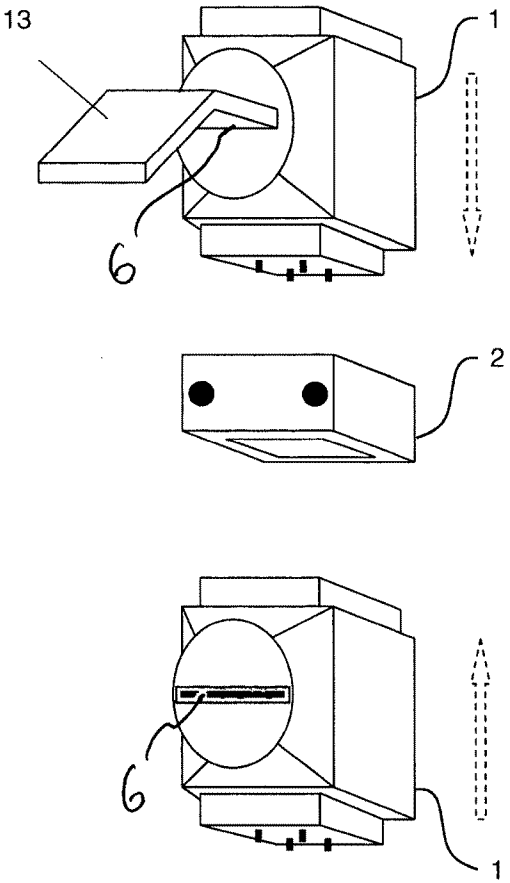

A safety switch assembly 100 according to the invention, having a construction from a plurality of modules 1 can be seen in FIGS. 1 and 2. The assembly 100 herein in the views illustrated in the figures is always constructed from a plurality of modules 1, that is to say at least two modules 1, which on their part are interconnected by fitting rings 2. To this end, two modules which when moved toward one another in the respective direction of the arrow can be interconnected at the connector pieces 5 thereof and which in the use position the fitting rings that frame the connector pieces 5 can establish the assembly 100 in an overall manner can be seen in FIG. 1. The modules 1 herein, like the fitting rings 2, have a substantially square basic cross section such that said modules 1 and said fitting rings 2 are fundamentally capable of being joined together so as to assume a position having overall flush exterior walls and so as to be spaced apart in angular steps of 90°.

The respective assembly 100 herein can also form a key transfer system such as can be derived from FIG. 2, for example. The modules 1 can contain various functions such as, for example, key modules 3, actuator modules 4, but also switch modules, command function modules, electrical/electronic connection modules or like modules 1 can also be provided on the assembly 100. Herein, combinations of functions in one module 1 are also possible, for example a module 1 which contains a command function as well as an electronic connection function. Two key modules 3, 3' having an actuator module 4 which to the observer is connected to the upper one of the key modules 3 can be seen in FIG. 2. Actuators 13 or 14, respectively, are in each case introduced into actuation openings 6 on the central key module 3 and on the actuator module 4 that can be seen above said central key module 3, while the respective opening of the lower key module 3 is free. The actuator 13 herein has the form of a socket key.

Figure 43:
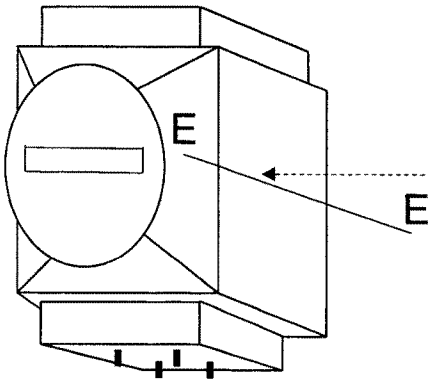
FIG. 43 shows a perspective lateral view of a module.
Figure 44:
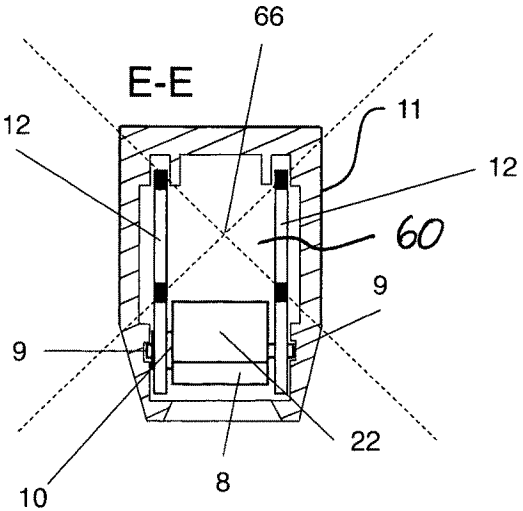
FIG. 44 shows a sectional end-side view of the module of FIG. 43 for highlighting the central region about a central longitudinal axis that has been left free.
Figure 3:
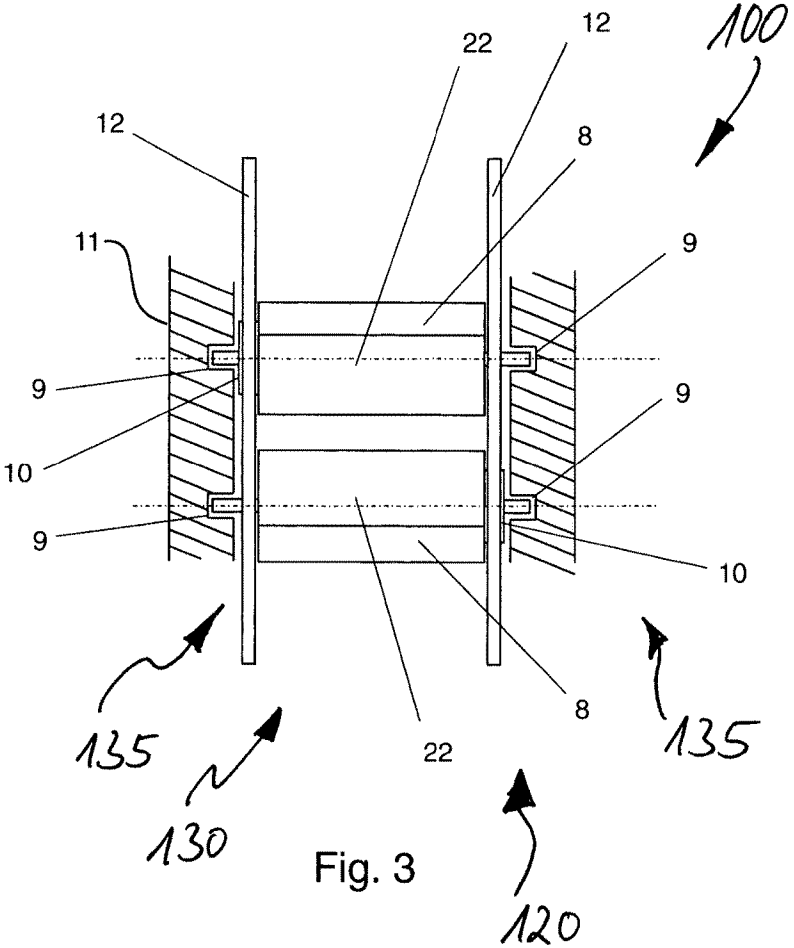
FIGS. 3-10 show the interaction of an actuation installation, a transmission installation, and a switch installation on a further exemplary embodiment of the safety switch assembly.

The interaction of a first embodiment of the safety switch assembly 100 having an actuation installation 110, a transmission installation 130 and a switch installation 120 is explained in FIGS. 3 to 10. The figures herein, supported by the illustrations of FIGS. 43 and 44, permit a view into the interior of the actuator modules 3, 4. In a manner so as to be substantially retrieved from the respective module housing, first transmission elements 8 of the transmission installation 120 that in each case are configured as rollers having a crescent-shaped cross section can be seen for the respective modules in FIG. 3 in the interior of the latter; said first transmission elements 8 being mounted in mutually opposite recesses 9 of the internal walls 11 of the module housing that in each case are neighboring to the ends thereof so as to be freely pivotable about axes 22 and to this extent and in a mutually independent manner. FIG. 44 shows a section E-E that can be seen in FIG. 43. As can be seen, the roller-type first transmission elements 8 are disposed between the switching members 12, but so as to be eccentric in relation to the central axis 66 of the module 1. On account of this eccentric positioning of the first transmission elements 8, there are no "collisions" with items such as cables or like additional conduits that are optionally to be disposed in the region of the central axis 66 of the respective module 1.

A second transmission element 10 that is configured as an eccentric is connected in a rotationally fixed manner to each of the first transmission elements 8. The two transmission elements 8, 10 in each case collectively form one transmission member 135 which is movable independently of one or a plurality of further transmission members 135. Two switching members 12 that are disposed so as to be mutually parallel and configured as slide plates can furthermore be seen, said switching members 12 being disposed on mutually parallel pivot axes 22 of the first transmission elements 8 and being placed in guides (not illustrated in more detail) of the module housing and being guided in the latter. Interacting switching members 12 and transmission members 135 in each case form a type of mechanical channel.

The switching members 12 can carry out a translatory movement along the two arrows in a direction that to the observer is downward. This translatory movement is achieved in that the eccentric of the second transmission element 10 in each case engages in a square interference fit 21 of one of the switching members 12. Should the first roller-shaped first transmission elements 8 rotate, the second transmission elements 10 also rotate. The eccentrics of the latter impact on the wall of the square interference fit 21 and thus urge the plate of the first transmission element 8 away in an upward or downward manner. It can thus be seen by means of this explanation that the switching members 12 are forcibly guided by the eccentrics of the second transmission element 10 of the respective transmission members 135. This means in particular that the switching members 12 are forcibly drivable or driven, respectively, by the respective transmission members 135.

In each case one first transmission element 8 by way of an eccentric of a second transmission element 10 drives in each case only one switching member 12 with a slide plate. Since the two first transmission elements 8 are mounted in a mutually independent manner in the recesses 9 of the housing wall, the switching members 12 can also be set in motion in a mutually independent manner. The mechanism which is formed by the roller-shaped first transmission elements 8, the eccentrics of the second transmission elements 10, and the switching members 12 is an actuation mechanism as illustrated in FIGS. 3, 4, 5, and 6. The first transmission elements 8 herein are set in rotation by means of an actuator 13, 14, for instance in the form of a key or a slide.

The actuators 13, 14 are assembled from two plate-type actuator parts 15 that lie flat on top of one another. Each of the two actuator parts 15 herein has embodied with an actuation portion 16 which is formed by half a cylinder, that is to say by a cylinder which is split along the longitudinal axis thereof such that an approximately semi-circular cross section results. The cylinder longitudinal axis herein is oriented transversely to the direction of actuation of the actuator 13, 14. The actuation portions 16 in each case engage in a form-fitting manner in the interference fits 17 of the first transmission element 8 (FIG. 4).

Figure 4:
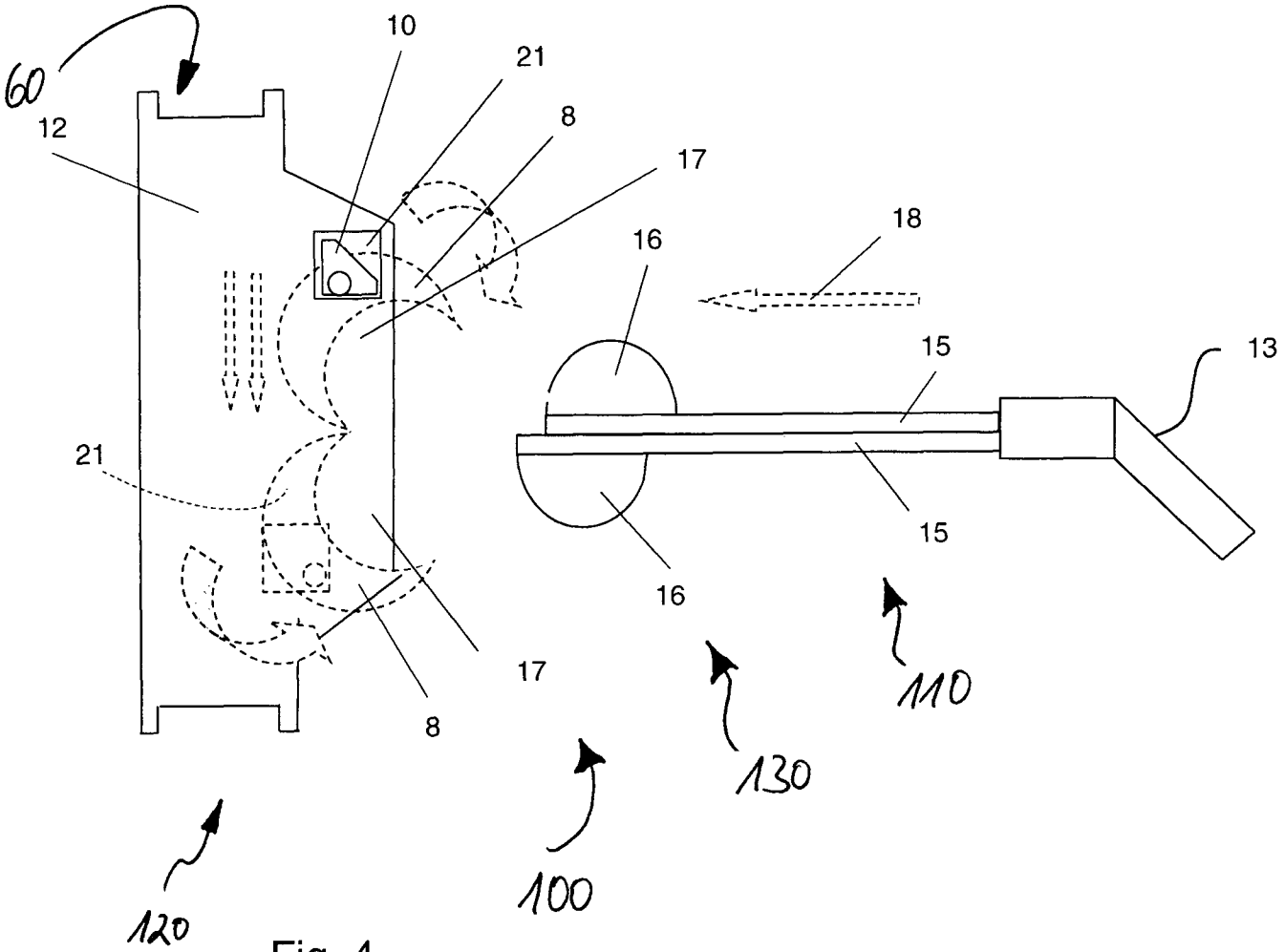
Figure 5:
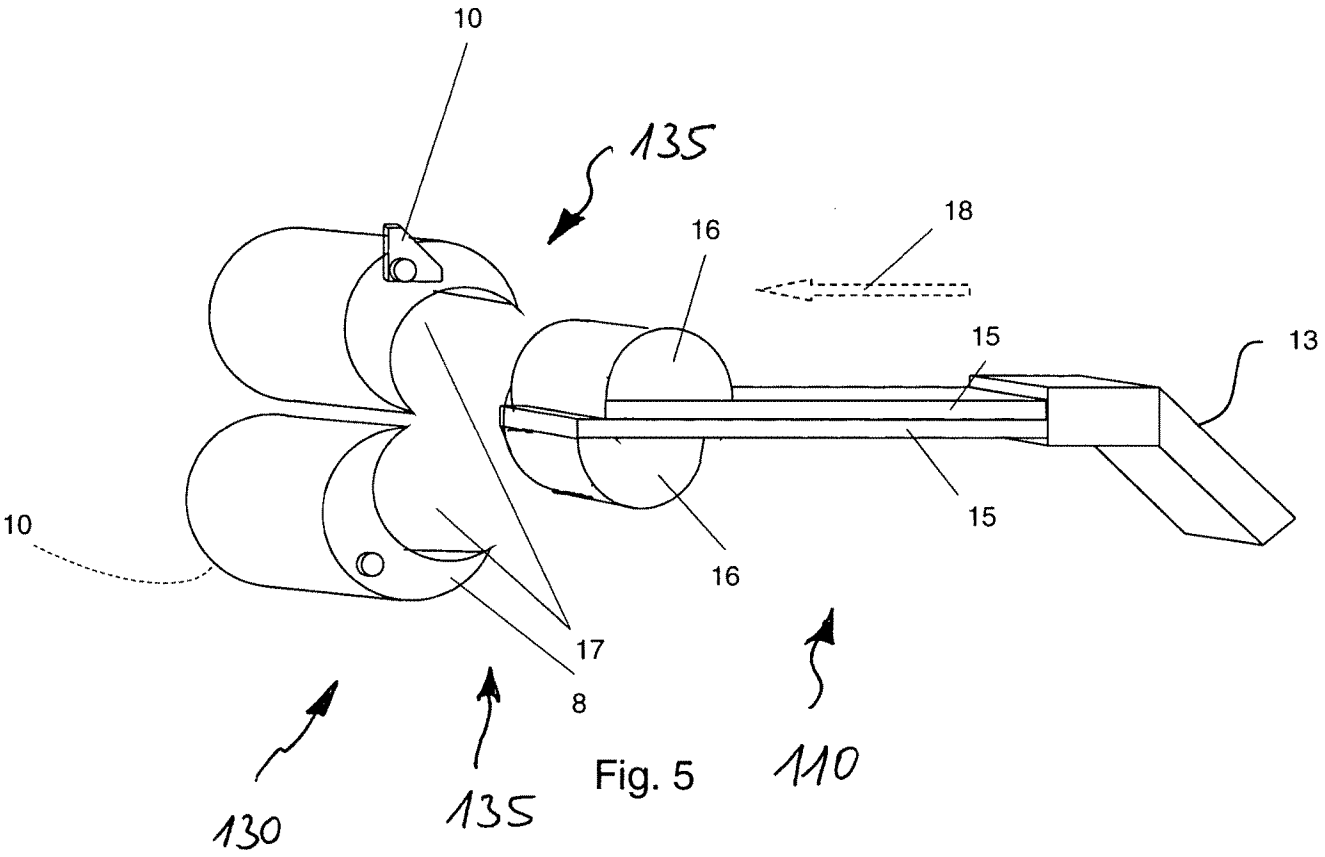
Figure 6:
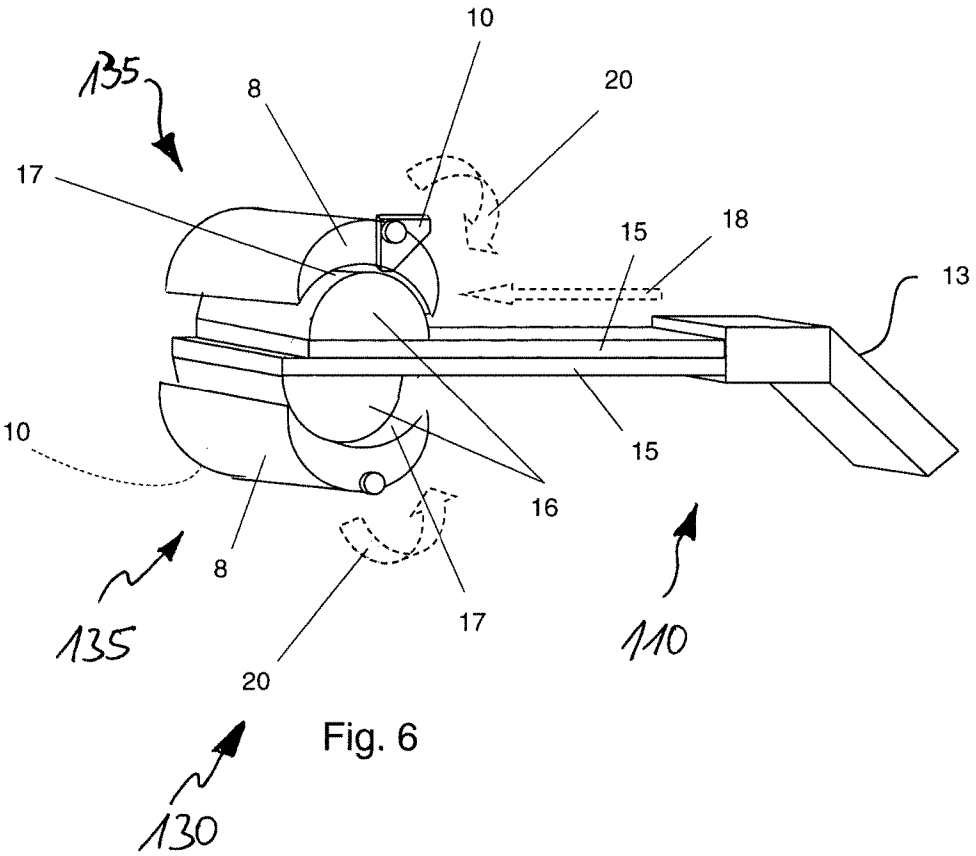
Figure 8:
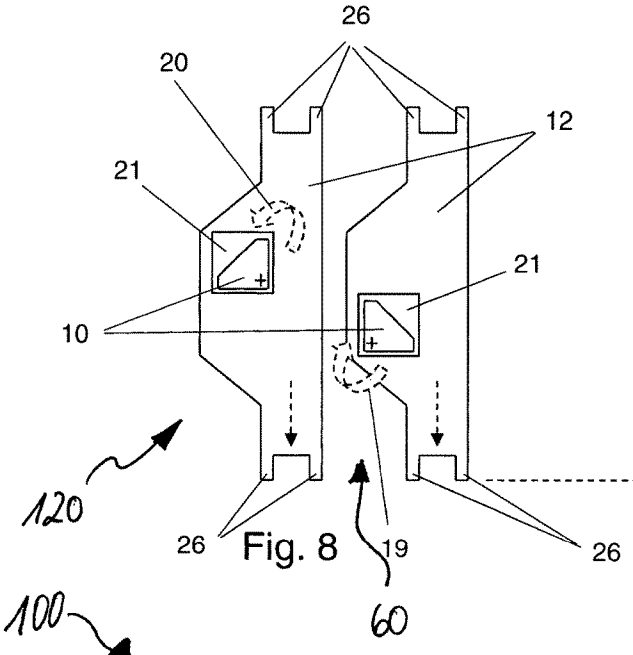
Figure 7:
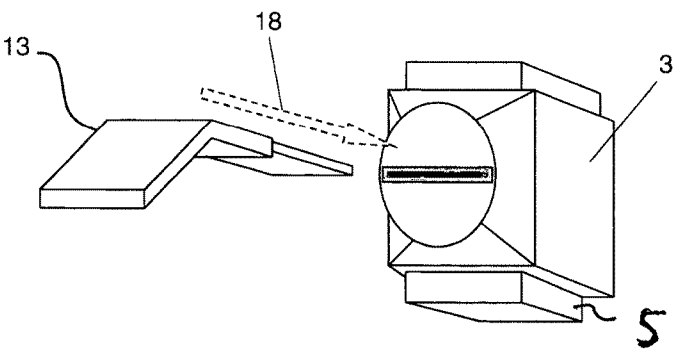
Figure 14:
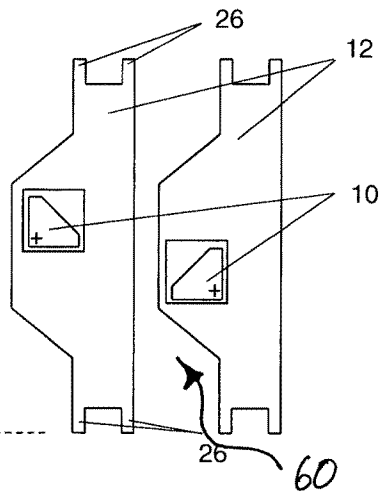
FIGS. 11-14 show the interaction of an actuation installation, a transmission installation, and a switch installation on a further exemplary embodiment of the safety switch assembly, the effective direction being reversed in relation to the preceding example.
Figure 13:
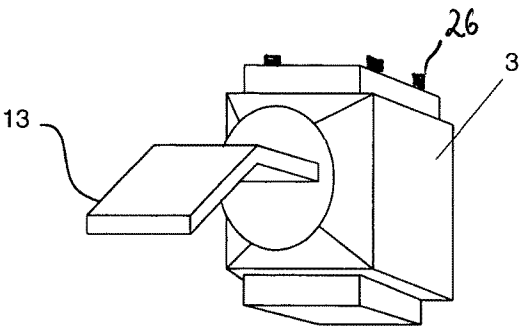

It can also be seen in FIGS. 5 and 6 that the actuation portions 16 in a translatory movement of the respective actuator 13, 14 in the direction of the arrow 18 (FIG. 4) engage in the interference fits 17 of the roller-shaped transmission elements 8 and set the latter in pivoting motion. On account of the pivoting movement of the rollers of the first transmission elements 8, the eccentrics 10 also rotate in the direction of the arrows 19, 20 and in turn set the plates of the switching members 12 in translatory motion (FIG. 7, FIG. 8). Since the rollers of the first transmission elements 8 on account of this form of drive are moved in opposite pivoting directions, the eccentrics of the second transmission elements 10 are mutually offset by 180°. Consequently, the switching members 12 on account of the pivoting movement of the first and second transmission elements 8, 10 as a result are driven in a mutually straight and parallel manner, that is to say in the same direction and so as to have the same path. It can moreover be seen in FIGS. 4 to 6 that the actuation parts 15 by way of the actuation portions 16 thereof, in the exact same manner as the first transmission elements 8 of the transmission installation 130, have an offset in the direction of actuation.

Figure 10:
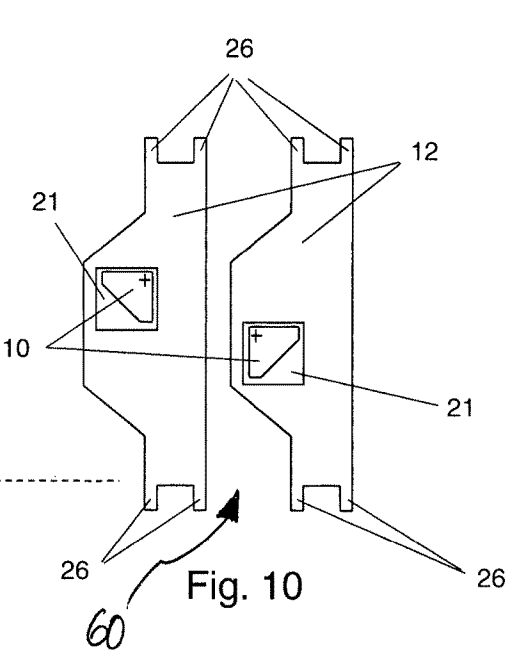
Figure 9:
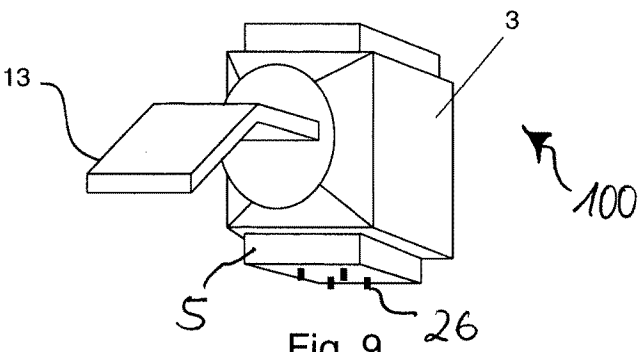

It can be seen in FIG. 7 how an actuator 13 in the form of a key is plugged into a key module 3. In FIG. 9 the same key module 3 is shown in that state in which said key module 3 is located upon reaching the terminal position of the actuator 13. FIG. 8 herein shows the position of the switching members 12 and of the second transmission elements 10 with eccentrics when the actuator 13 has again not yet been plugged in. FIG. 10 shows the position of the switching members 12 with the slide plates thereof and of the second transmission elements 10 with the eccentrics when the actuator 13 has been plugged in up to the terminal position of the latter. When the actuator 13 is fully plugged in (FIG. 9) the switching members 12 are located in the lower position thereof (FIG. 10), and the eccentrics of the second transmission elements 10 have rotated to the respective position of said eccentrics that in relation to the previous position of said eccentrics is offset by 90°, specifically in respectively opposite directions in the case of the two eccentrics. This change can be seen both by means of a positional change in terms of an imaginary height in relation to the dashed auxiliary line that is drawn between FIGS. 8 and 10, as well as by means of the situation that switching protrusions 26 that are disposed on the lower ends of the switching members 12 project from the lower connector piece 5 on the module 3 of FIG. 9, said module 3 corresponding to this position of the switching members 12.

It can be seen in both FIG. 4 as well as in FIG. 44 that the transmission installation 130 having the transmission elements 8, 10 thereof is disposed between regions of the switching members 12 of the switch installation that project counter to the direction of actuation of the actuators 13, 14. On account thereof, an available space 60 that is free of moving transmission elements 8, 10 and of switching members 12 and extends in the manner of a channel along the direction of movement of the switching members 12, specifically across the entire length of the module 1, is formed between the two switching members 12 of the module 1 that are mutually opposite in a spaced apart manner. This space is to be found about the central longitudinal axis of a module portion having an approximately square cross section.

Figure 12:
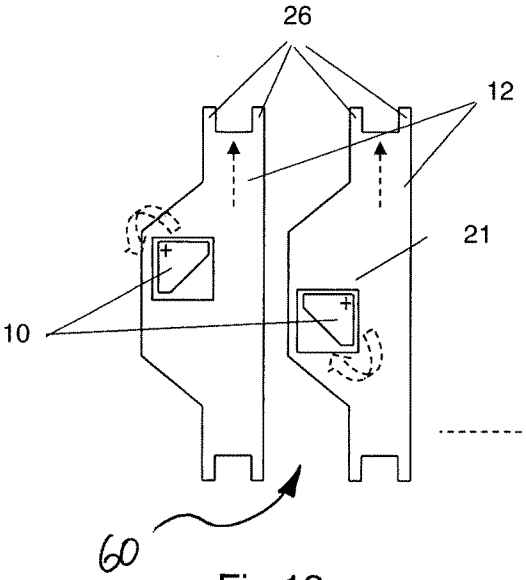
Figure 11:
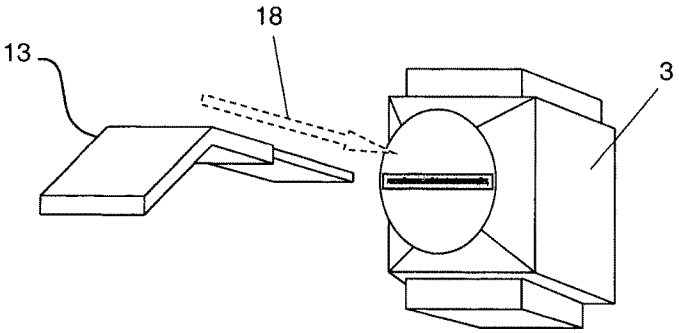

The direction of movement of the two mutually opposite switching members 12 herein is not limited to the direction of movement as has just been described, but can also be directed in the direction counter thereto. This can be achieved by reversing the effective direction of the eccentrics of the second transmission elements 10, as is illustrated in FIGS. 11 to 14. To this end, a key module 3 into which the assigned actuator 13 that is to be plug-fitted in the direction of the arrow 18 has not yet been plugged can be seen in FIG. 11. The positions of the switching members 12 and the second transmission elements 10 with eccentrics are shown in FIG. 12. When the actuator 13 (FIG. 13) is plugged in, the switching members 12 are displaced in an upward manner. As is the case in FIGS. 8 and 10, the dashed line 23 serves for explaining the various positions of the switching members 12.

Figure 23:
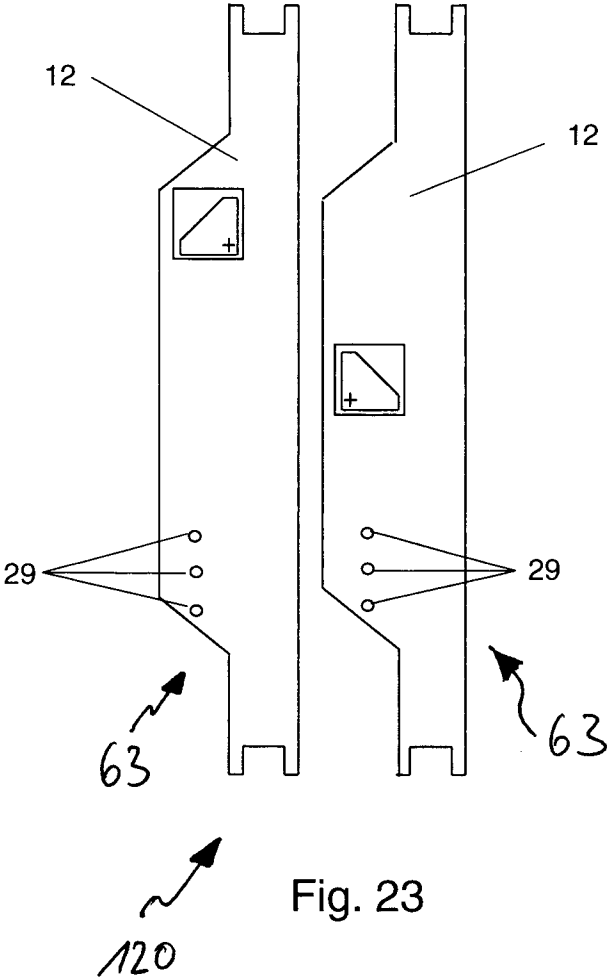

In the intervening time referring to FIG. 23, it can be derived from the latter how the plates of the switching members 12 in the module housing 11 are disposed so as to be mutually parallel. The switching members 12 herein are disposed in such a manner that the switching protrusions 26 among one another form a square symmetry within the module housing 11, such as can also be derived from FIG. 30, for instance.

Figure 16:
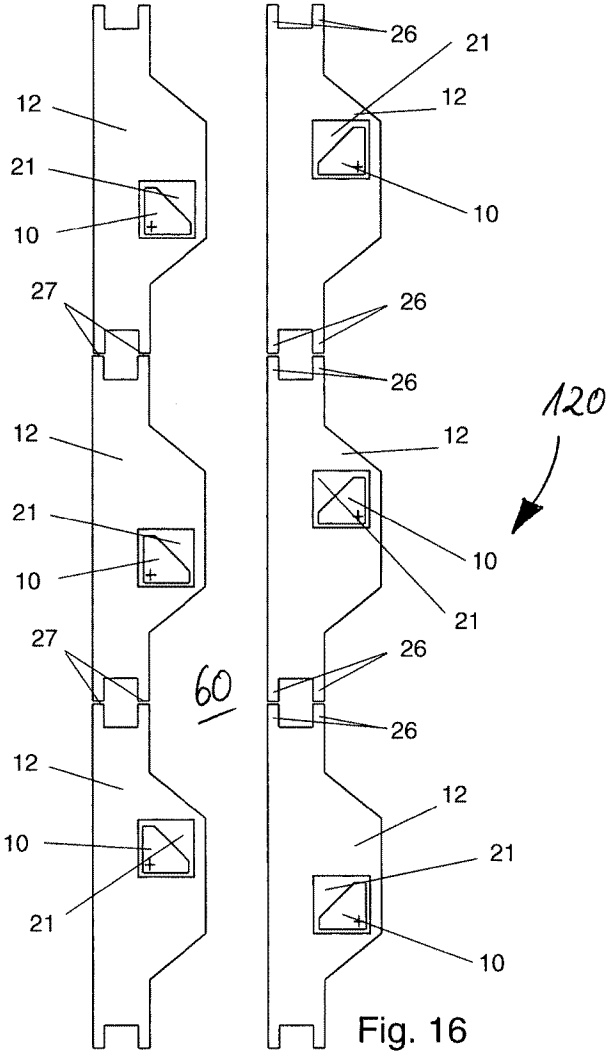
FIGS. 15-22 show a mechanical transfer of functions across module boundaries in the case of a further exemplary embodiment of the safety switch assembly.
Figure 38:
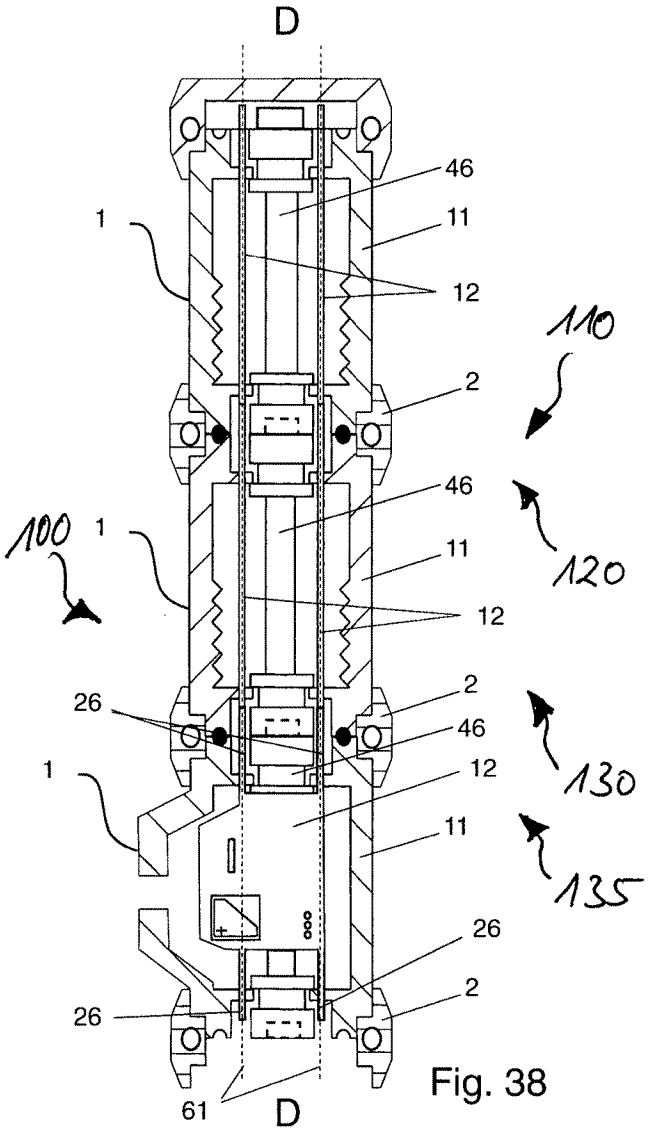

If fundamentally arbitrary modules 1 are interconnected, the switching protrusions 26 are at all times located along identical effective axes 61, such as is indicated in FIG. 38, said switching protrusions 26 are independent of the direction of assembly 28 of the module 1. The length of the switching protrusions 26 herein is provided such that the latter do not contact one another in the case of modules in the assembled state and when the switching members 12 of the modules 1 are in the same position, but that said switching protrusions 26 also do not provide any wiggle room 27, as can be seen in FIG. 16. On account thereof, it is guaranteed that when a module 1 is to be operated the latter has to have its operability cleared by another module 1. The action of switching members 12 of the switch assembly 120 and of the eccentrics of the second transmission elements 10 of the transmission installation 130 and the effects thereof on the functioning of the safety switch assembly 100 is explained in FIG. 15 up to and including 22 with the aid of an exemplary safety switch assembly 100.

FIGS. 15 to 22 show a safety switch assembly 100 in which an actuator 14 is plugged into the upper module 4. An actuator 13 in the form of a key is plugged into the central module 3. No actuator is plugged into the lower module 3; however, the plug-fitting of an actuator 13' in the form of a key is possible.

Figure 15:
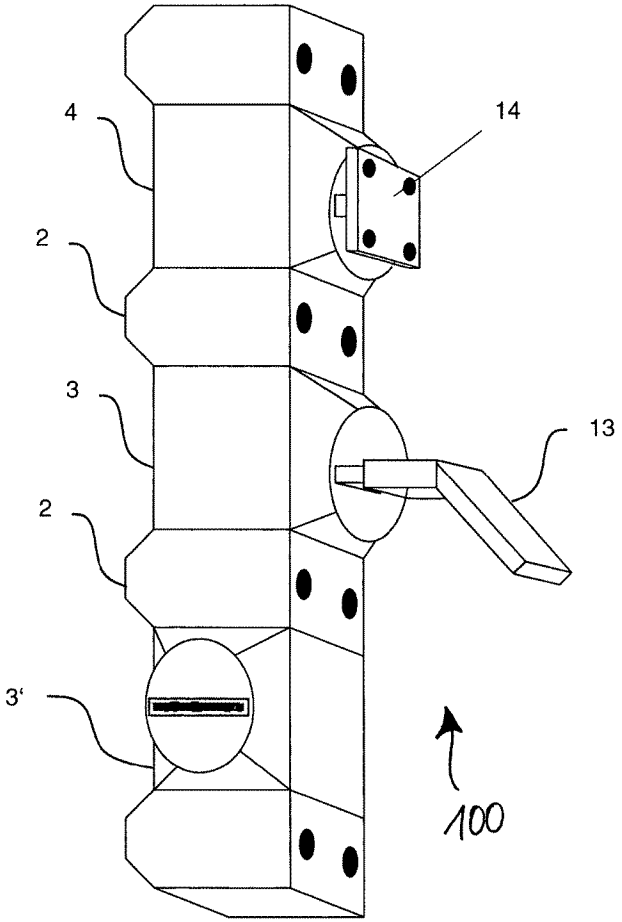
Figure 18:
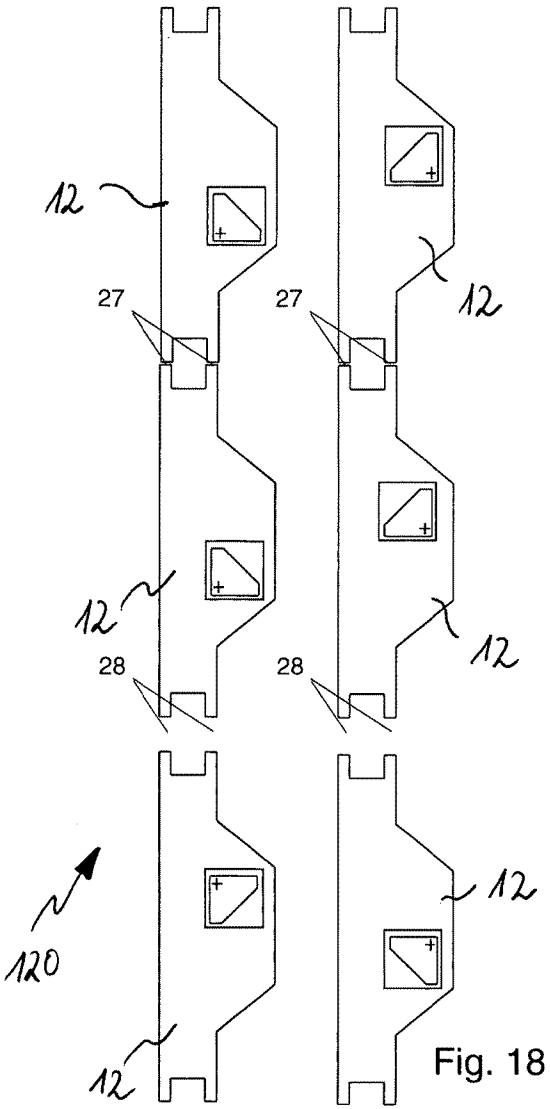

FIG. 16 shows the positions of the switching members 12, and how the eccentrics of the second transmission elements 10 in the assembly 100 of FIG. 15 are positioned in the square interference fits 21. For instance, if the key-shaped actuator 13 is to be retrieved from the central module 3, the eccentrics of the second transmission elements 10 of this very module 3 will also rotate, and the switching member 12 will be displaced. Since the switching members 12 of the lower module 3 are in their upper position, the switching protrusions 26 of the central module 3 impact on the switching protrusions 26 of the lower module 3. On account thereof, the switching members 12 of the central module 3 cannot move, on account of which the respective eccentrics of the second transmission elements 10 also cannot move. Since the eccentrics of the second transmission elements 10 are incapable of moving the central module 3, the first roller-shaped transmission elements 8 of said eccentrics also cannot be pivoted. However, since the key-shaped actuator 13 has two actuator portions 16 which are positioned in a form-fitting manner in the assigned interference fits 17 of the roller-shaped first transmission elements 8 and said transmission elements cannot be pivoted, the key-shaped actuator 13 also cannot be retrieved. This situation applies in an analogous manner also to the upper module 4.

Figure 17:
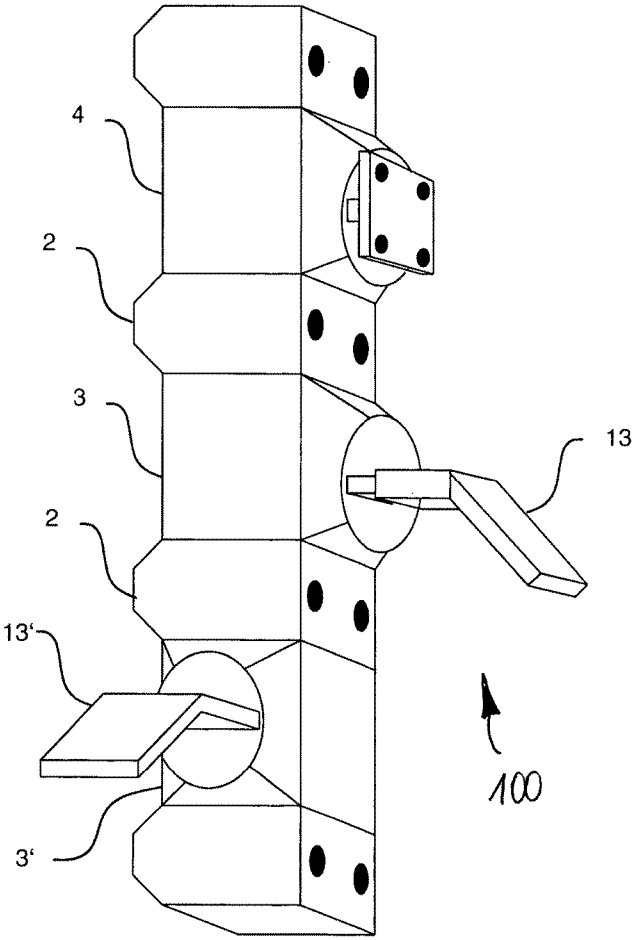

To this end, FIG. 17 now shows how a key-shaped actuator 13' has been plugged into the lower module 3'. On account thereof, the roller-shaped first transmission elements 8 like the second transmission elements 10 with eccentrics have been pivoted. This in turn has had the effect that the switching members 12 have been moved downward. On account thereof, a free space 28 has been created between the switching protrusions 26 of the central module 3 and the switching protrusions 26 of the lower module 3'. On account thereof it has become possible for the key-shaped actuator 13 to be retrieved from the central module 3.

Figure 20:
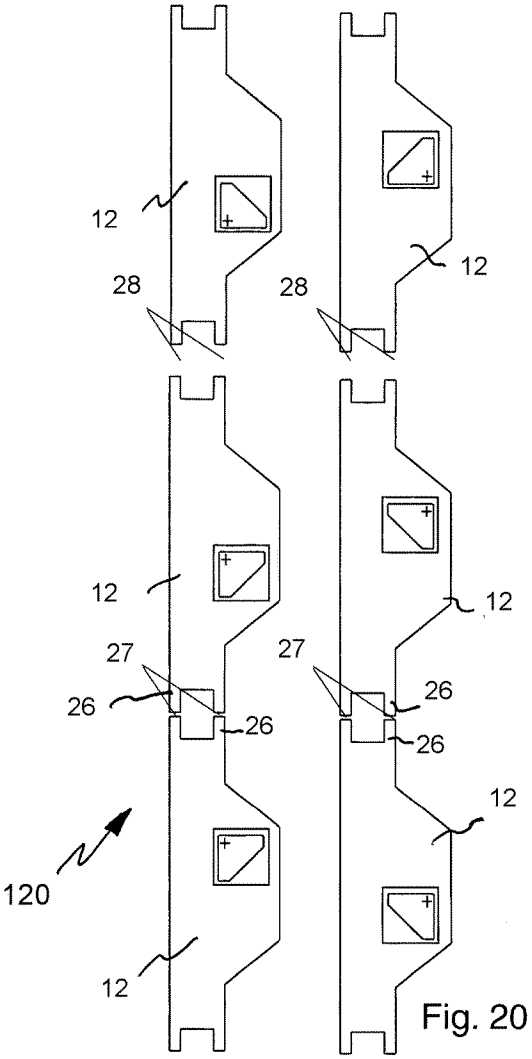
Figure 19:
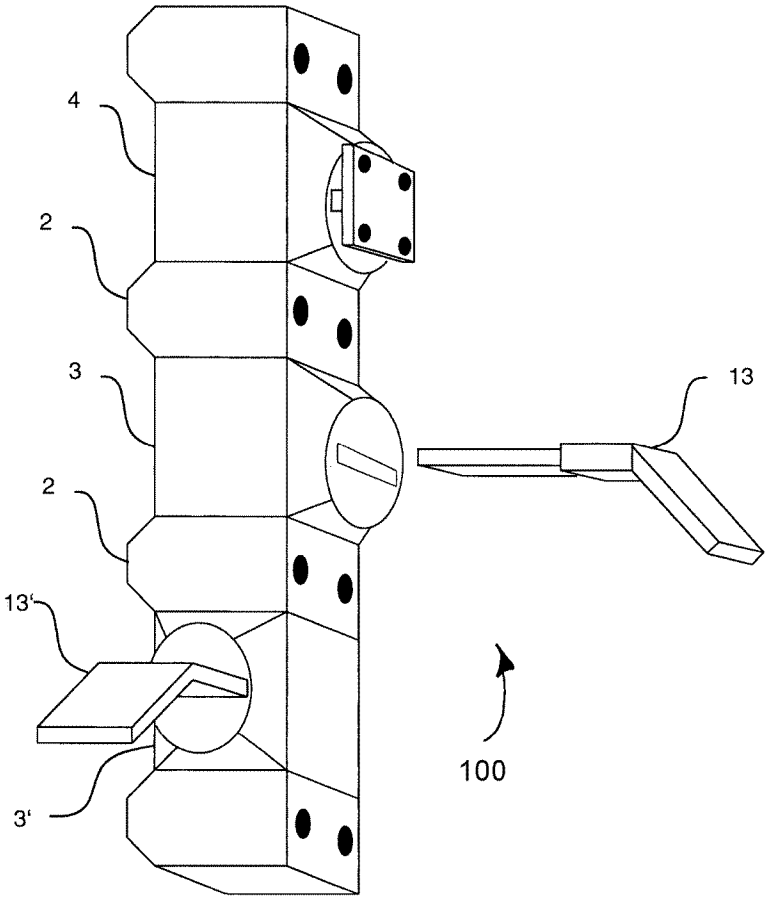
Figure 22:
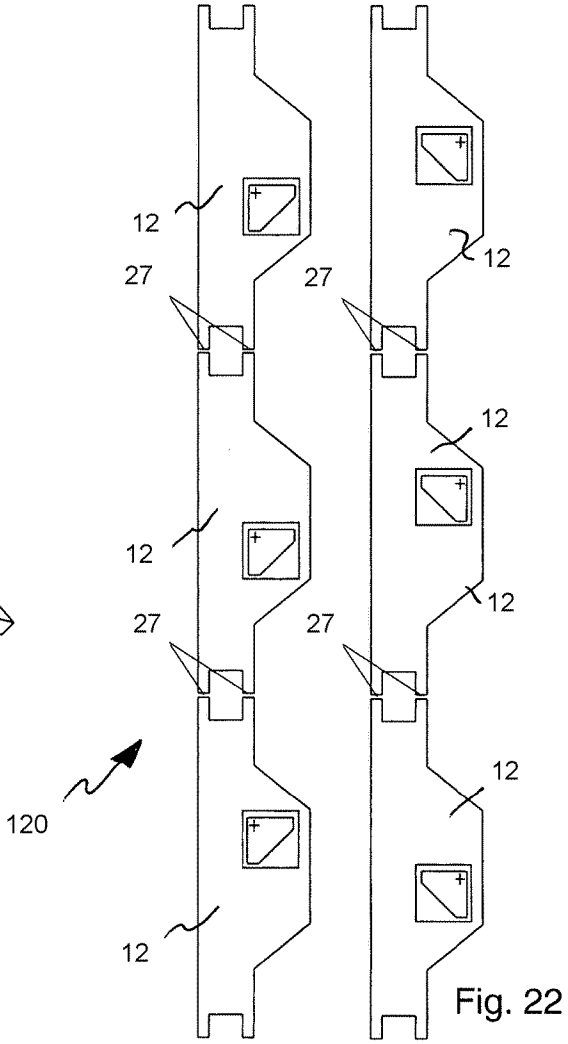

FIG. 19 shows the same safety switch assembly 100 as in FIGS. 15 to 18, wherein the key-shaped actuator 13 has been retrieved from the central module 3. FIG. 20 shows the state of the switching members 12 of the switch installation 120 of the assembly 100 of FIG. 19. The switching members 12 of the central module 3 have moved downward. On account thereof, the mechanism of the upper module 4 is now released; the mechanism of the lower module 3' is simultaneously blocked, since in the retrieval of the key-shaped actuator 13' of the lower module 3' the mechanism of the latter should move upward, this however not being possible in this state since the switching protrusions 26 of the lower module 3' and those of the central module 3 impact on one another. The key-shaped actuator 13' of the lower module 3' is now "trapped" and fixed in the safety switch assembly 100 of FIG. 19. The actuator 14 of the upper module is simultaneously free and can be retrieved.

Figure 21:
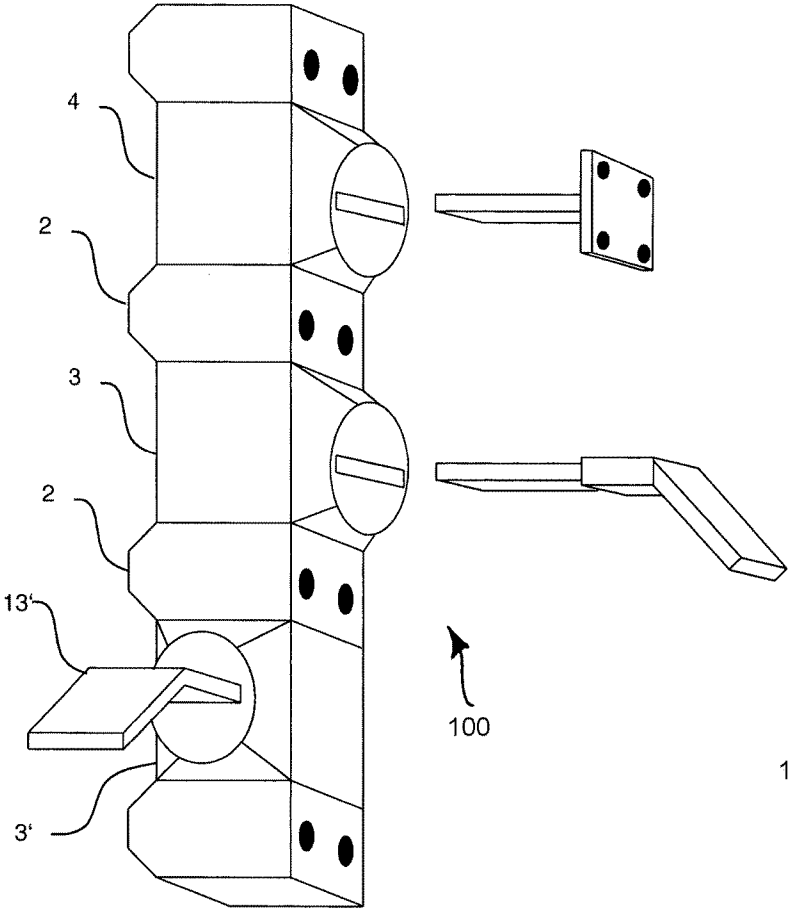

FIG. 21 shows the state of the same safety switch assembly 100 as is illustrated in FIGS. 15 to 20, however having the actuator 14 retrieved from the upper module 4. In this state, the key-shaped actuators 13, 13' of the central module 3 and of the lower module 3' can neither be plug-fitted nor retrieved, respectively, since this is prevented by the actuation mechanisms of the three modules 3, 3', 4 that form the safety switch assembly 100. Only once the actuator 14 has been plug-fitted again will the switching members 12 of the mechanism of the module 4 move upward, such that the key-shaped actuator 13 of the central module 3 can be and consequently plug-fitted again. Consequently, FIGS. 15 to 22 thus show the effect of the positions of the switching members and how interdependencies are achieved in a safety switch assembly 100.

By contrast, FIGS. 3 to 10 show the effect of the actuation mechanisms within the modules 3, 3', 4 and moreover show that this mechanism is constructed from two effective lines (channels). Each effective line, or each channel, respectively, at this point is composed of in each case one transmission member 135 having a roller-shaped first transmission element 8, and of one second transmission element 10 with the eccentric that is connected in a rotationally fixed manner to said first transmission element 8, and of one switching member 12 of a switch installation 120 that is operatively connected to said transmission member 135, all said components being installed in one module housing 11. In turn, a plurality of transmission members 135 form the transmission installation 130. The two channels mentioned act in parallel but in a mutually independent manner.

Figure 24:
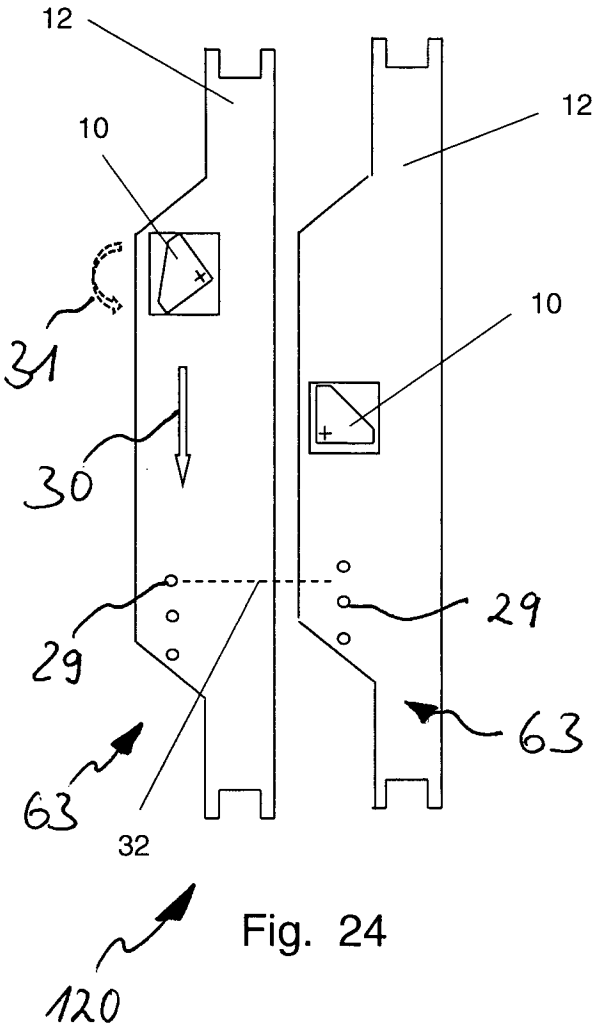
FIGS. 23-28 show the monitoring of the function of the mechanical multi-channel construction of an exemplary embodiment of the safety switch assembly.

In order for monitoring of the functioning of the two channels to be established, openings 29 which are disposed in sensor regions 63 of the respective switching members 12 are located in the switching members 12. These openings 29 which are present in both switching members 12 are mutually opposite and can be assigned to an in each case identical effective plane. FIG. 23 shows how the openings 29 are positioned so as to be mutually opposite on the sensor regions 63. It can furthermore be seen to this end from FIG. 24 that when only one eccentric of the first transmission element 10 rotates in the direction of the curved arrow 31, only the associated switching member 12 is also displaced in the direction of the straight arrow 30. On account thereof, the openings 29 are no longer mutually opposite, this being highlighted by means of a dashed auxiliary line 32.

Figure 25:
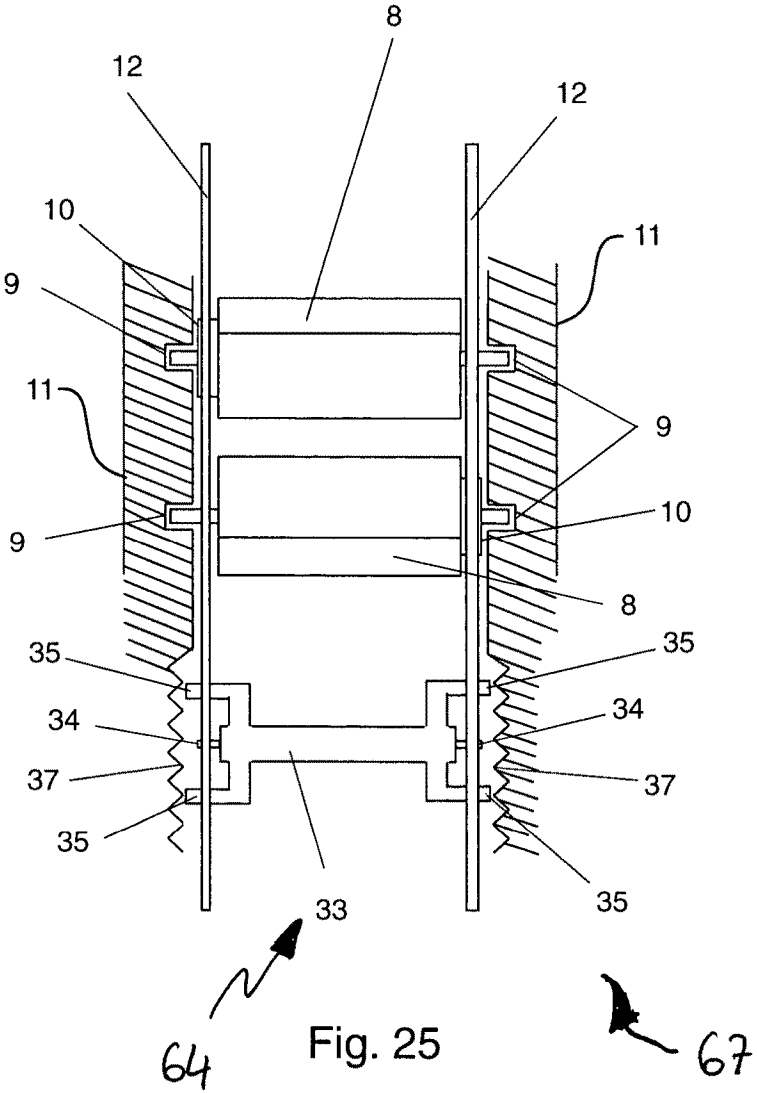

It can be seen in FIG. 25 that a diagnostics element is disposed and fixed in a plug-fitted manner in the openings 29 of the two switching members 12, said diagnostics element specifically being a connection web 33 as a position sensor 64. The connection web 33 at both ends thereof has at least one blocking means 65, presently two blocking pins 35 which frame a positioning pin 34 on two sides. The position sensor 64 is hooked in transversely between the switching members 12, so as to be movable in tilting manner in the direction of the connection of the connection web 33. Should the switching members 12 move simultaneously and in the same direction, the position sensor 64 is conjointly moved without modifying the angle of said position sensor 64 in relation to the switching members 12.

Figure 26:
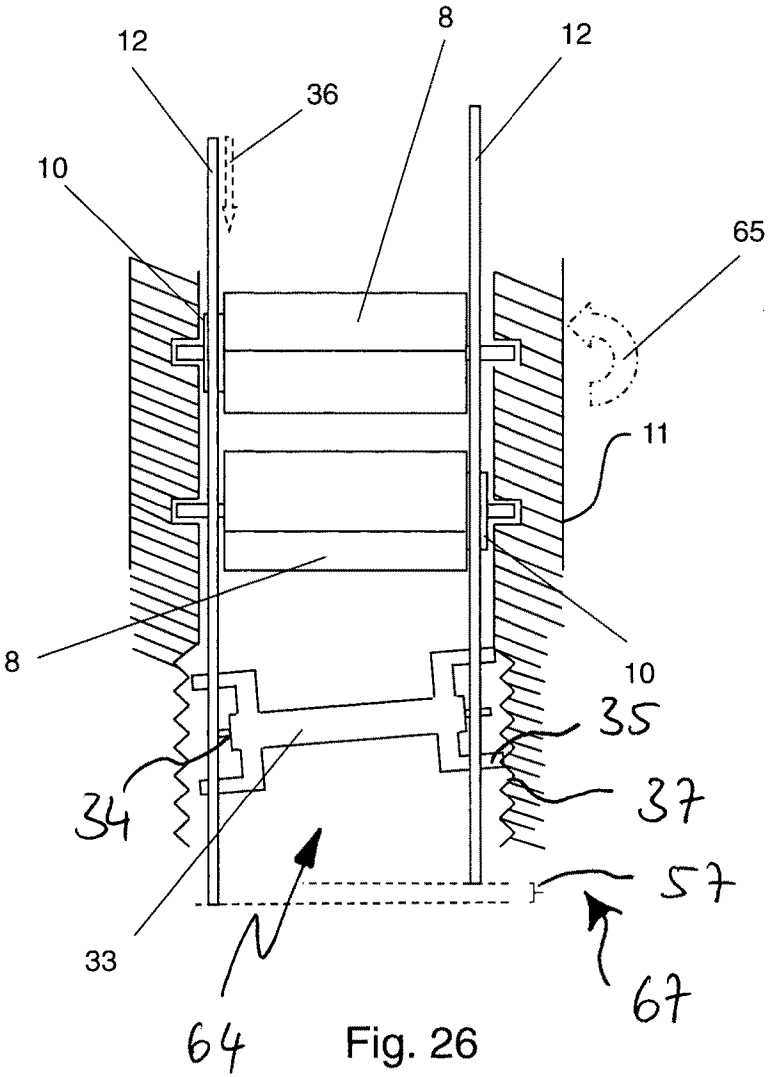

However, should only one of the roller-shaped transmission elements 8 be driven along the direction of the arrow 65 in FIGS. 25 and 26, then only one switching member 12 is also moved in the direction of the arrow 36. On account thereof, the openings 29 are no longer mutually parallel, and the connection web 33 of the position sensor 64 is moved only unilaterally. The two positioning pins 34 keep the position sensor 64 in position in relation to the switching members 12. However, since one of the two switching members 12 is being driven and on account thereof displaced, the connection web 33 of the position sensor 64 is also conjointly moved and in relation to the switching members 12 is no longer perpendicular to the switching members 12, which can be readily seen in the difference in level 57 of the two switching members 12. The blocking pins 35 herein are so long that they protrude through the openings 29 and protrude from that side of the switching member 12 that in each case faces away from the connection web 33. Since the connection web 33 no longer is perpendicular to the switching members 12, one of the blocking pins 35 on each external side of the switching members 12 protrudes farther outward than the other blocking pin 35 on the respective side; in FIG. 26 these are the blocking pin 35 on the lower right and at the blocking pin 35 the upper left.

Groove-type interference fits 37 which form a blocking piece 67, and by way of which the blocking pins in the case of a non-uniform movement of the switching members engage are located on the housing walls 11 that are opposite the blocking pins 35. Specifically, when the connection web 33 is perpendicular to the switching members 12, the blocking pins 35 and the interference fits 37 are not in mutual contact. However, when the connection web 33 of the position sensor 64 does form an angle in relation to the switching members 12 then as is shown in FIG. 26 one of the blocking pins 35 on each side protrudes farther from the slide plates of the switching members 12 and contacts the chamfers 3) (FIG. 26). This in turn prevents the free movement of the driven switching member 12 and thus prevents further rotation of the roller-shaped first transmission elements 8 along the direction of the arrow of the arrow 65. On account thereof it is prevented that an actuator 13, 14 can be plug-fitted or retrieved.

Figure 28:
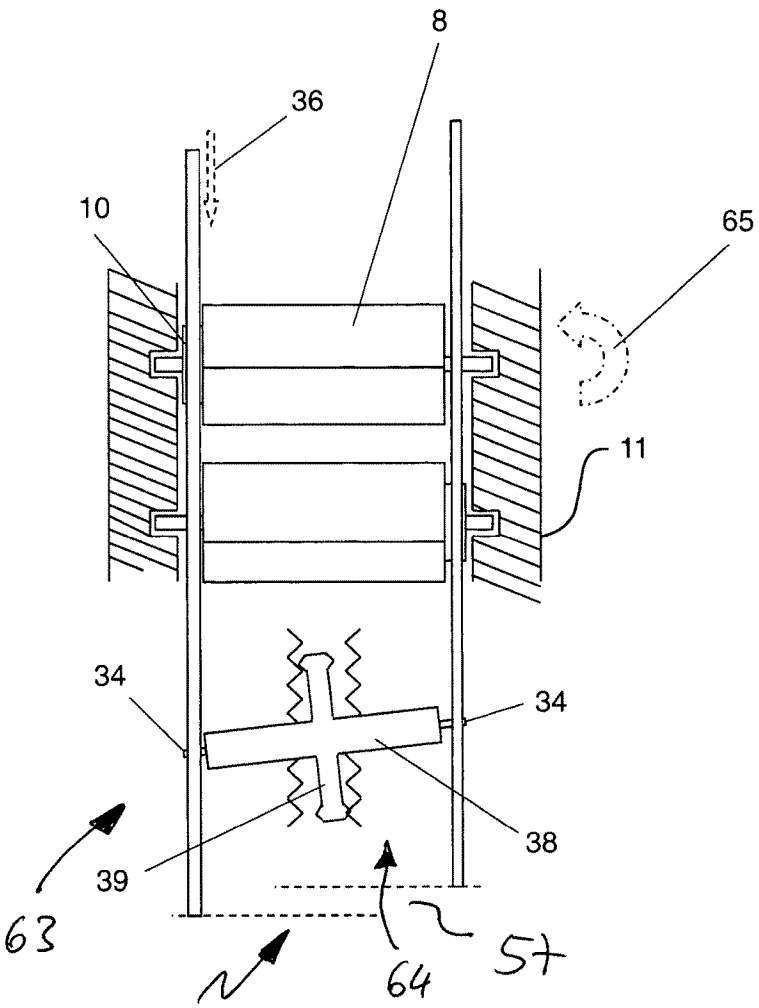
Figure 27:
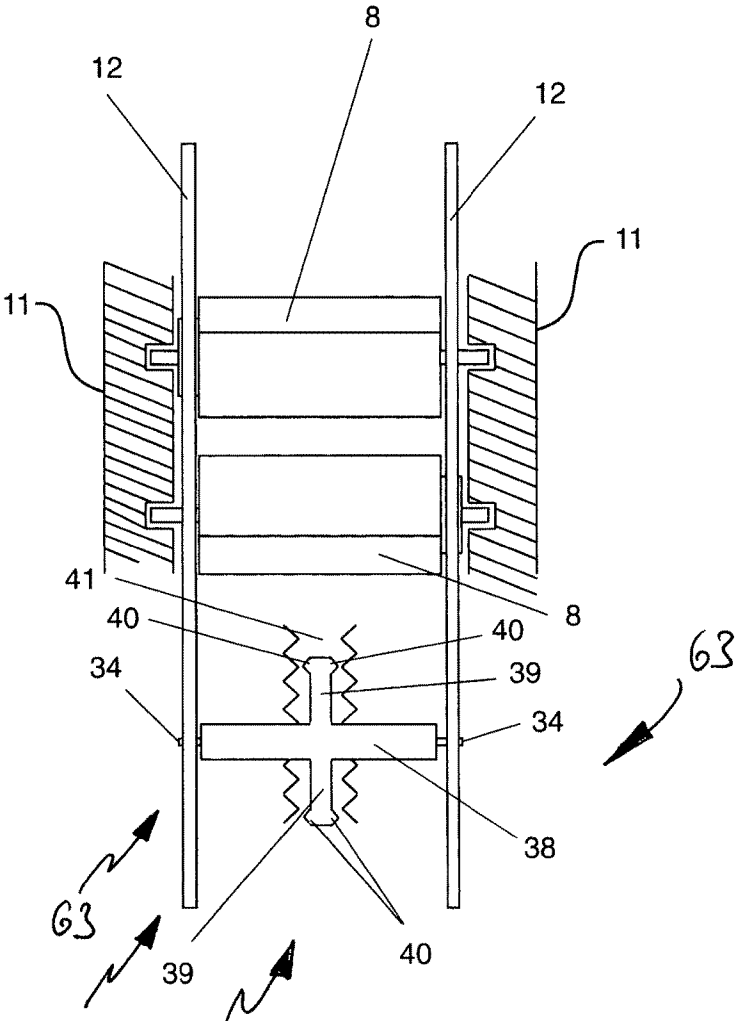
Figure 42:
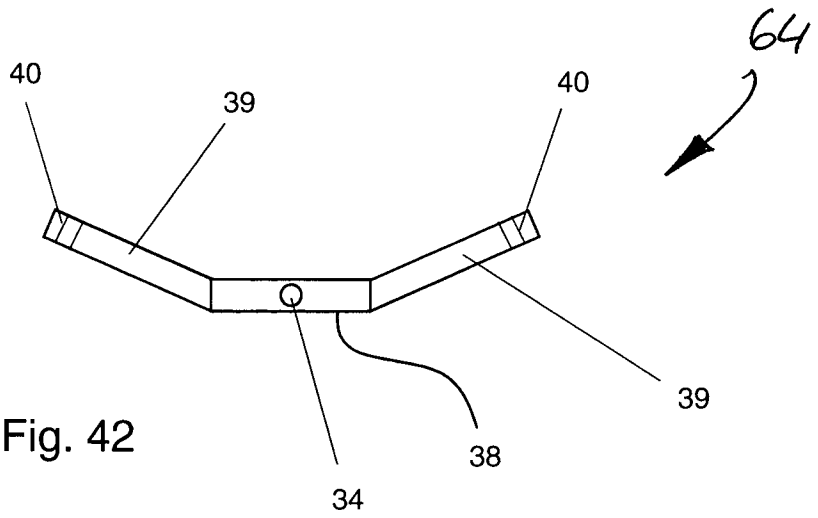
FIG. 42 shows a lateral sectional view of a connection web as a position sensor of FIGS. 27 and 28.

The position sensor 64 as a diagnostic element can also be embodied in a different shape. For example, said position sensor 64 can be cruciform, as can be seen in FIGS. 27 and 28. On this cruciform connection web 38 in each case only one opening 29 on the respectively opposite sensor regions 63 of the switching members 12 is populated with a positioning pin 34. In a central region of the connection web 38 of the position sensor 64, arms 39 which at the free ends thereof are provided with protrusions 40 project from said position sensor 64 on mutually opposite locations of the connection web 33. Together with the cross section of the connection web 33, the arms 39 that project in the direction toward the same housing wall form a curved blocking means. The protrusions 40 that are located at the free ends of the arms 39 are thus disposed so as to be eccentric in relation to the openings 29 of the sensor regions 63 of the switching members. The protrusions 40 herein are designed such that the former in the case of a synchronous movement of the switching members 12 can run freely through a groove 41 in the same housing internal wall 11, as is shown in FIG. 27. The groove chamfers 42 are located on the internal side of this groove 41. These groove chamfers 42 are designed such that the protrusions 40 can catch therein, as can be derived from FIG. 28. In principle, this works in a manner identical to that of the first connection web 33. The advantage of the cruciform connection web 38 herein is that the latter in comparison to the first embodiment can be constructed and positioned in a more space-saving manner. This second connection web as a position sensor 64 is shown again in the cross section in FIG. 42.

The switching members 12 of the safety switch assembly 100 are positioned such that the former leave free a centerline 66 along the longitudinal extent of the modules 1, the available space 60 of the respective module 1 being located about said centerline 66.

Figure 29:
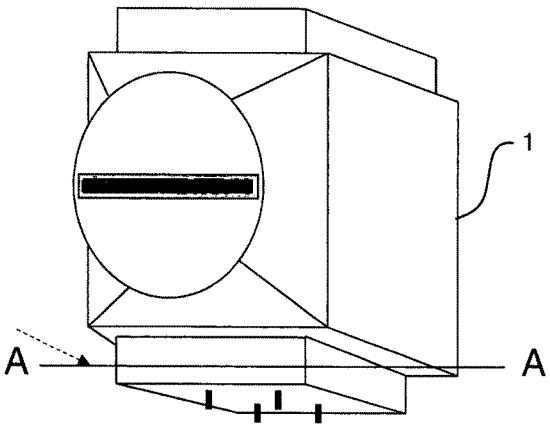
Figure 30:
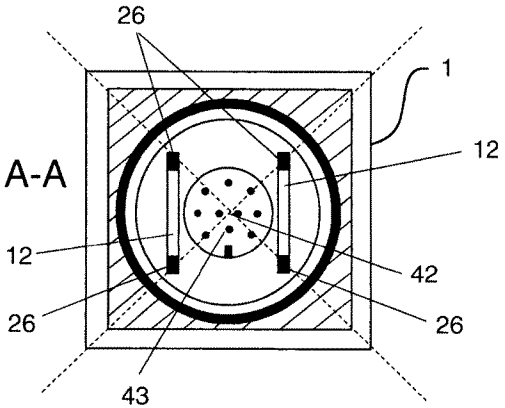
Figure 35:
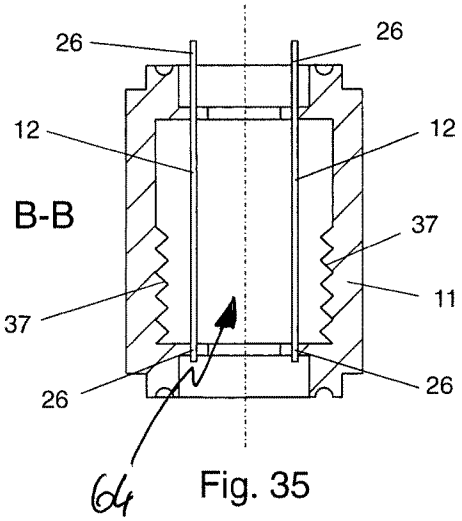

FIG. 30 shows the section A-A of a module 1 of FIG. 29. The switching members 12 are positioned such that they form an arrangement that is square in the cross section. The available space 60 in which an electrical plug connecter 46 extends between the ends 44, 45 of the module 1 is located between the two switching members 12.

Figure 32:
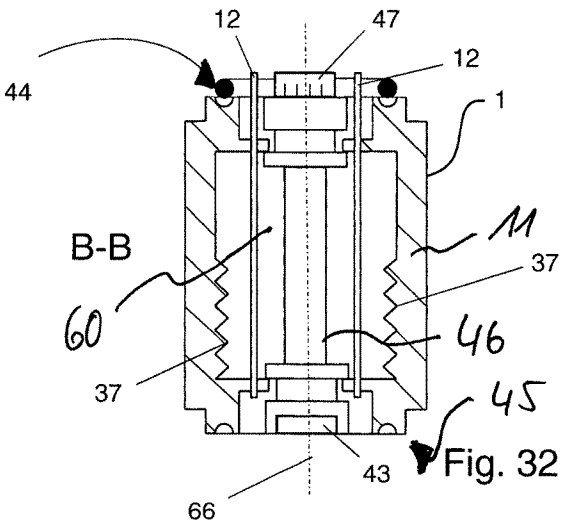
Figure 36:
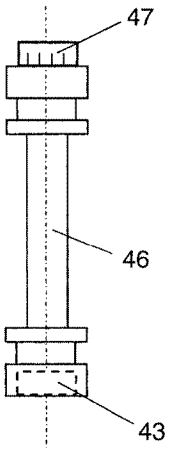

The respective electrical plug connector 46 is shown in FIG. 36. This electrical plug connector 46 in the form shown, on an end thereof that to the observer of FIG. 32 is the upper end has a male plug 47, and on the other, lower side has a female plug 43. The electrical plug connector 46 extends from the end 44 of the module that to the observer of FIG. 32 is the upper end to the lower end 45 of said module.

The switching members 12 and the roller-shaped first transmission elements 8 are positioned such that the two former do not collide with the electrical connectors that are configured as plugs 43, 47 and with the assigned electrical plug connector 46.

Figure 31:
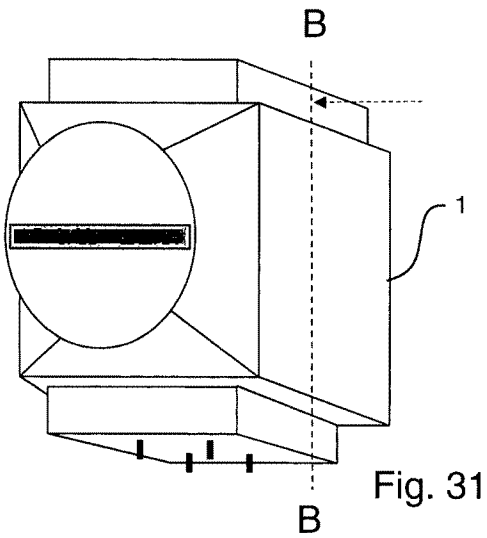
FIGS. 29-41 show the arrangement of additional functions in a available free space of modules of a further exemplary embodiment of the safety switch assembly that are disposed so as to be mutually neighboring.

The section B-B of FIG. 31 is shown in FIG. 32. It can be clearly seen that the switching members 12 are positioned next to the electrical plug connector 46 and to the associated female and male plugs 43, 47, or run so as to be spaced apart from said connector and plugs, respectively. The electrical plug connector 46 lies in the central axis 42 of the module 1. On account thereof, it is possible for the electrical plug connector 46 to be disposed in a rotating manner. Said situation in turn permits the modules 1 to be able to be assembled in one unit so as to be angularly spaced apart in steps of 90°, such as can be derived for instance from FIG. 2.

Figure 33:
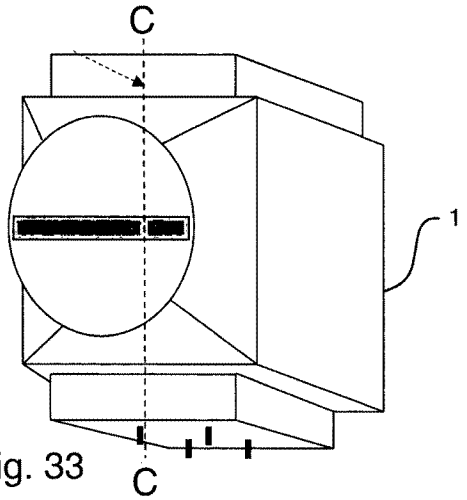
Figure 34:
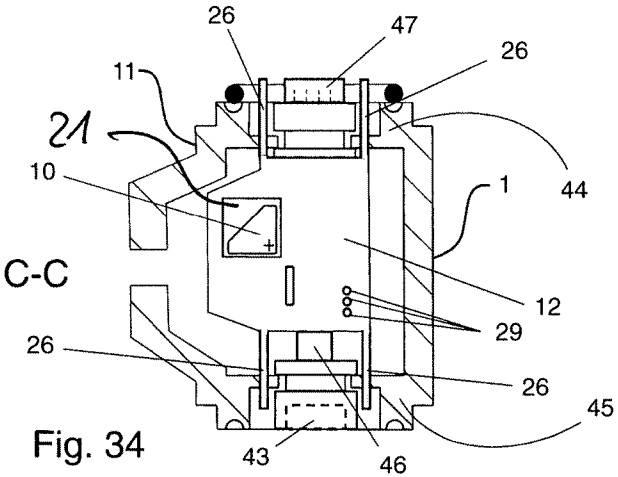
Figure 37:
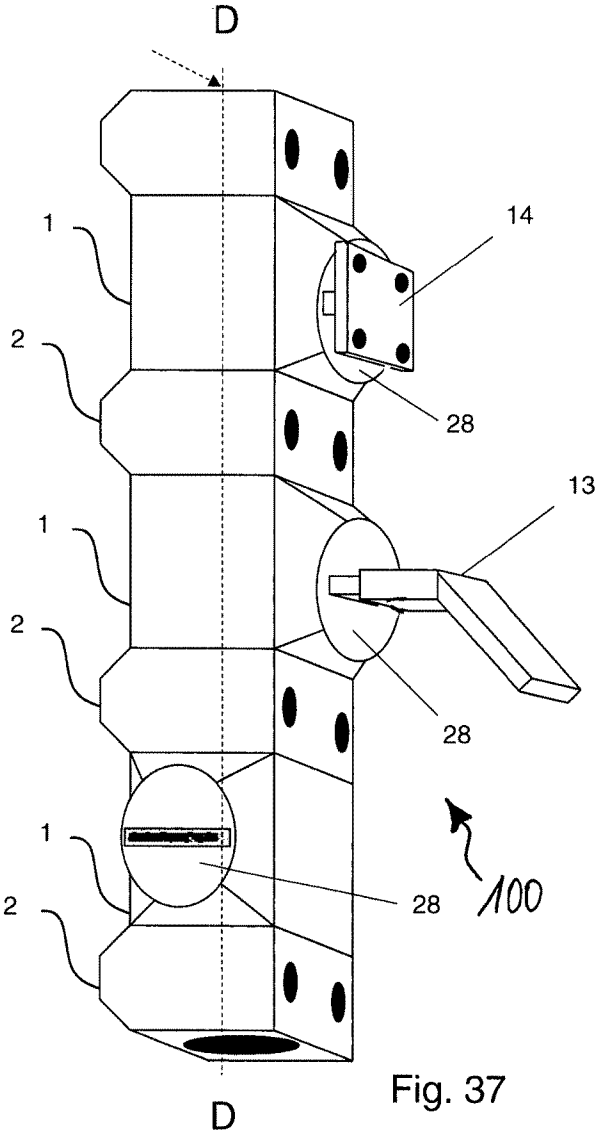

FIG. 34 shows the section in the plane C-C of FIG. 33. The switching members 12 in this view are disposed in front of and behind the electrical plug connector 46, the observer looking toward the facing switching member 12. The eccentric of the second transmission element 10 is located on the side of the switching member 12 that is to the left for the observer of FIG. 34, said eccentric there engaging in the interference fit 21 which is located on a region of the switching member 12 that projects in this direction. FIG. 38 shows the section D-D of FIG. 37.

The modules 1 are disposed on top of one another and are fastened to one another by means of the fitting rings 2. The switching members 12 are all disposed on top of one another and act by way of the effective lines 27 that run so as to be mutually parallel. The electrical plug connectors 46 are in each case also disposed on top of one another and interconnected. The electrical plug connectors 46 serve for transmitting signals through modules 1, the latter moreover having mechanical functions. On account thereof, it is in particular permissible for electrical or electronic functions, respectively, to be able to be positioned arbitrarily on the safety switch assembly 100. The electrical plug connector 46 herein can also have various modes of construction. Potential forms are plug connectors 46 such as the plug connector already shown, or else terminal connectors 51 or T-shaped electrical plug connectors 52, as can be seen in FIG. 39.

Figure 40:
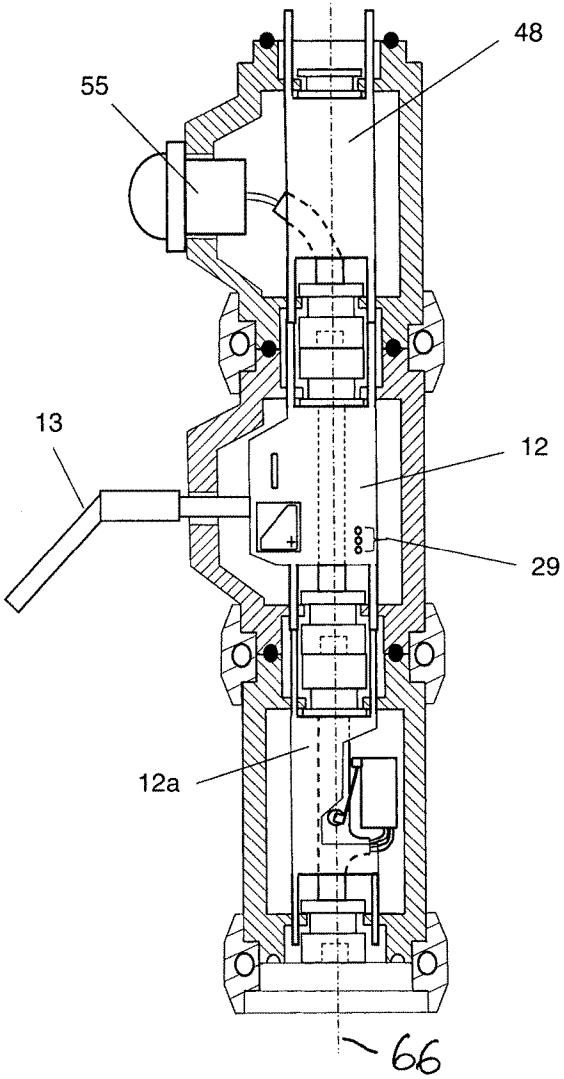
Figure 39:
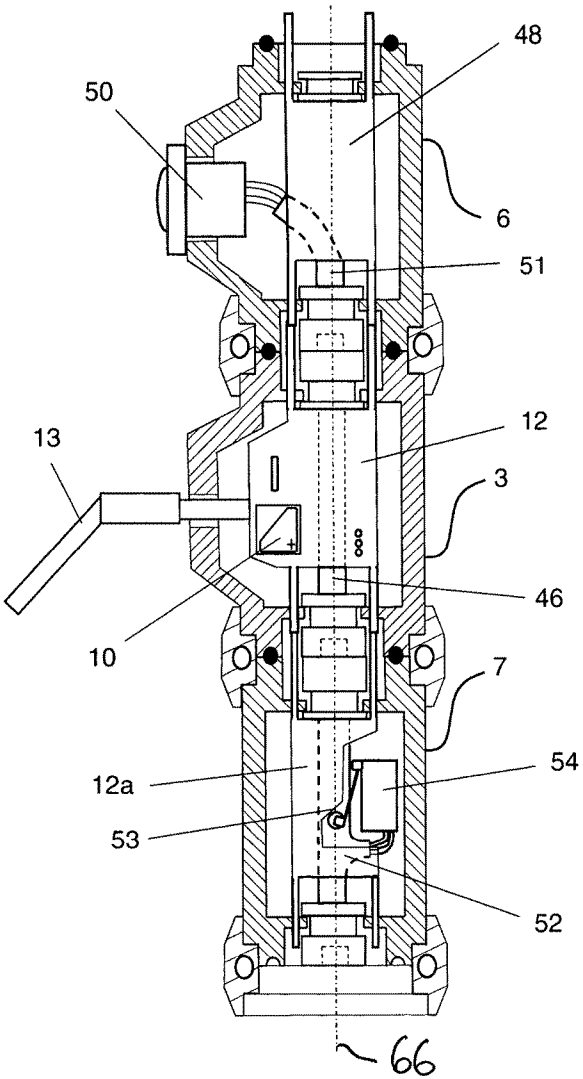
Figure 41:
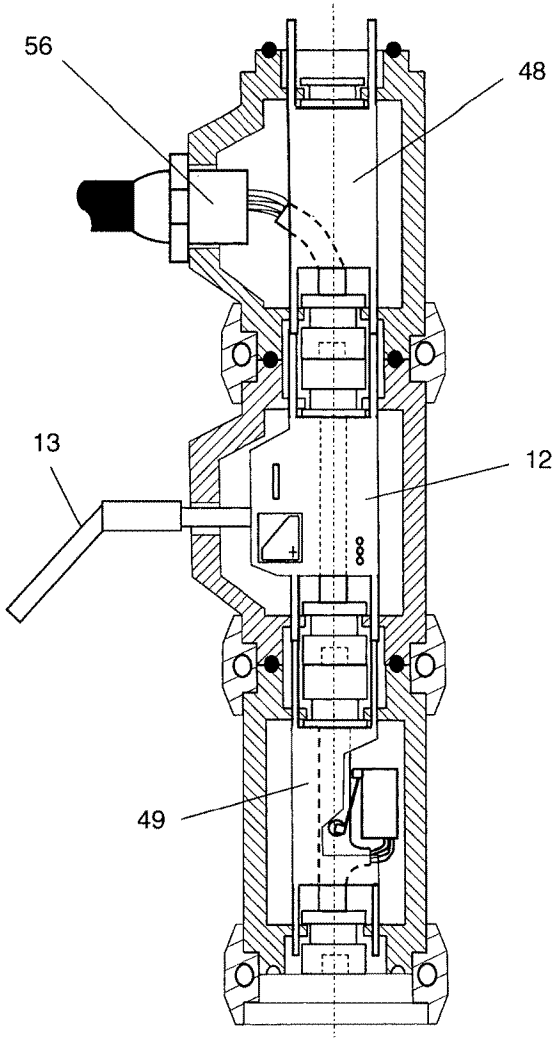

FIGS. 39, 40, and 41 show how various modules having various functions can be constructed.

FIG. 39 shows how a switch module 7 is disposed and assembled below a key module 3. A command function module 9 is disposed and assembled above the key module 3. A push button 50 is connected to an electrical terminal plug connector 51. The electrical plug connector 46 of the key module 3 is connected to the latter in a plug-fitting manner, and the T-shaped electrical plug connector 52 of the switch module 7 is in turn connected in a plug-fitting manner to said electrical plug connector 46 at its opposite end. The switch module 7 has two switching members 12*a* that in the profile are approximately ramp-shaped. A roller-lever switch 54 is disposed next to the ramp-shaped movable sheet metal plate 53 of said switch module 7. When the ramp-shaped slide plate 53 in FIG. 39 is moved downward because the former is urged downward by the switching member 12 of the key module 3, the roller-lever switch 54 is also switched. The roller-lever switch 54 in turn is connected to the T-shaped electrical plug connector 52.

When the contacts of the roller-lever switch 54 are switched, the output signals can be transmitted by way of the various electrical plug connectors 52, 51, 46 to a superordinate controller (not illustrated in more detail). The switch that is configured as a roller-lever switch 54 could also for example be configured as a switch that acts in a non-contacting manner (proximity switch, RFID, magnetic, or the like).

The functions which are coupled to the various electrical plug connectors 46, 51, 52 can be of various types. Said functions, apart from roller-lever switches 54, proximity switches, RFID switches, magnetic switches, push buttons 50, can also include signal lamps 55 or the like, signal emitters, or else connection technology to machine controllers by means of multicore cables 56, for example.

Referring to FIGS. 45 to 48, an alternative construction form of a key module 3" can be seen therein. Instead of the actuation opening 6 that has been shown previously on modules 3, 3', 4, a rotating key cylinder 68, the function and construction form of the latter being well known in various embodiments, and in which a rotating key 13 carries out a rotary actuation movement as opposed to the previously shown translatory actuation movement of the actuators 13, 13', 14 is disposed on this module 1 that is configured as a key module 3".

Figures 45, 46:
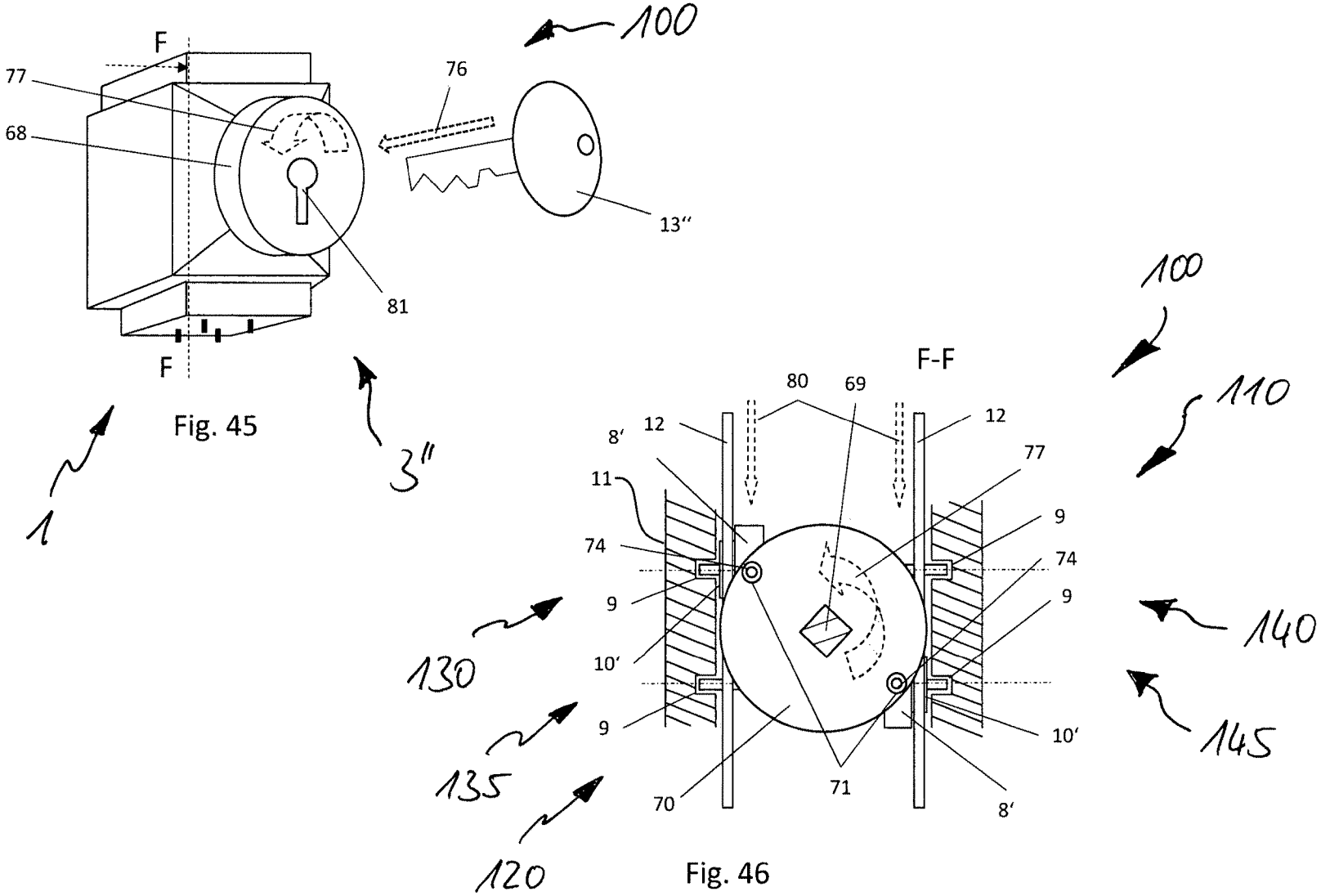
FIGS. 45-48 show a further exemplary embodiment of the safety switch assembly according to the invention, in which a key-shaped actuator carries out a rotary movement which by first and second transmission elements of a transmission installation drives switching members that are set in translatory motion.
Figure 48:
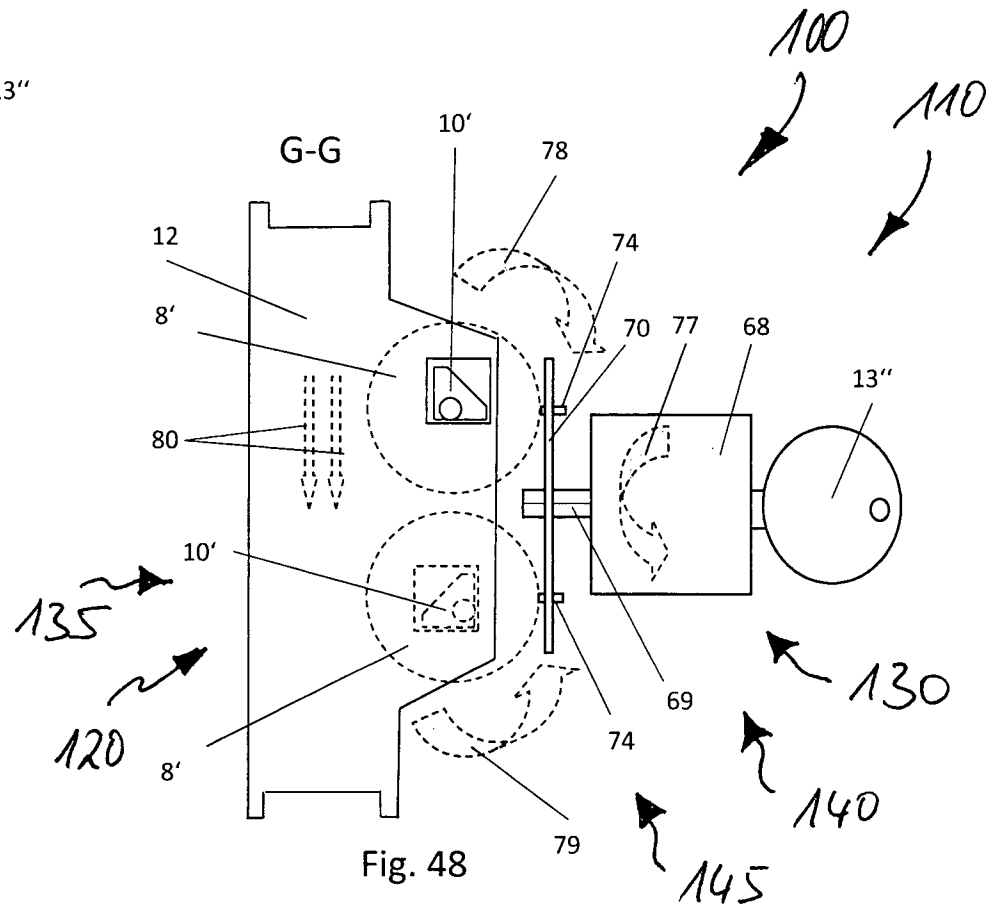
Figure 47:
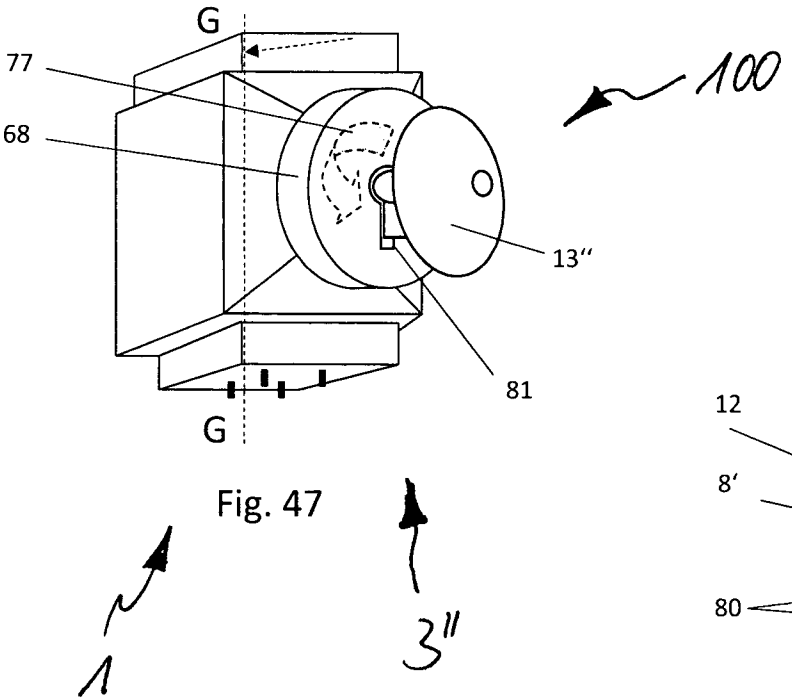

As can be seen in FIGS. 46 and 48, the rotating key cylinder 68 shown herein is fixedly connected to a drive shaft 69. In turn, a gearbox part 140 that is embodied as a rotary disk 70 and moreover also forms a cam gear 145 can be seen on the drive shaft 69, wherein the drive shaft 69 engages axially through the center of the rotary disk 70, the latter being mounted on said drive shaft 69 in a rotationally fixed manner.

Two entrainment openings 71 which penetrate the rotary disk 70 in the axial direction, so as to be parallel with the drive shaft 69, are to be found on the rotary disk 70 of the cam gear 145, in the peripheral region of said rotary disk 70, so as to be mutually opposite in relation to the disk area.

The first transmission elements 8' in the embodiment of FIGS. 45 to 48 are configured so as to be disk-shaped, and the disk-shaped transmission element 8' that to the observer is the upper transmission element 8' as well as the disk-shaped transmission element 8' that to the observer is the lower transmission element 8' are connected to the second transmission element 10' that is assigned to the respective transmission member 135 thereof. The disk-shaped first transmission elements 8' herein in each case have one bolt-shaped or pin-shaped dog 74 which in each case projects radially from the respective first transmission element 8'. Each of the two dogs 74 herein protrudes into one of the entrainment openings 71 of the rotary disk 70 and engages through the latter. In a movement of the rotary disk 70 the dogs 74 on the transmission elements 8' are movable in such a manner that said dogs 74 are entrained and conjointly perform the movement of the rotary disk 70 such that the transmission elements 8' in turn perform a rotary movement about the mounting axis thereof.

If, as is shown in FIGS. 45 to 48, the actuator 13" having the form of a rotating key 75 is plugged into the rotating key opening 81 of the rotating key cylinder 68 in the direction of the arrow 76, and if the rotating key 75 is subsequently rotated in the direction of the arrow 77, then the drive shaft 69 on account thereof also rotates in the direction of the arrow 77, and thus also the rotary disk 70 that is connected to the drive shaft 69 in a rotationally fixed manner.

The entrainment openings 71 in the rotation of the rotary disk 70 entrain the dogs 74, on account of which the disk-shaped first transmission elements 8' are set in opposing rotary motion (direction of the arrows 78, 79).

On account thereof, the second transmission elements 10' are also set in rotary motion. In a manner identical to the embodiments having actuators 13, 13', and 14 that act in a translatory manner and in part are already configured so as to be key-shaped (13, 13'), the components used are assembled in the module 1, and the switching members 12, 12*a* are driven and set in translatory motion along the direction of the arrow 80.

Not shown in the figures is an expedient connection between the first transmission elements 8' and the rotary disk 70 as the cam gear 145 of a gearbox part 140, said connection potentially also being advantageously configured as a gear drive.

Accordingly, the invention described above relates to a safety switch assembly 100 having a switch installation having at least one switching member 12, 12*a* and at least one actuation installation 110 having at least one assigned actuator 13, 13', 14, wherein a transmission installation 130 having at least one transmission member 135 which is coupleable or coupled to the switching member 12, 12*a*, on the one hand, and to the at least one actuator 13, 13', 14, on the other hand, is provided between the actuation installation 110 and the switch installation 120.

In order to have available a safety switch assembly 100 in which a mechanical fault does not lead to a failure of that functionality that optionally permits the integration of a diagnostic function in order for the system in the case of a fault being detected to be able to be brought back to a safe state and that permits a transfer of mechanical as well as of electrical/electronic functions across the entire system, the transmission installation 120 is provided with a plurality of separate transmission members 135 which in the actuation of the at least one actuator 13, 13', 14 of the actuation installation 110 are drivable or driven in a synchronous and mutually independent manner, and each of the transmission members 135 by way of a rotary movement converts an actuation movement of the at least one actuator 13, 13', 14 to a translatory movement of in each case one separate switching member 12, 12*a* of the switch installation 120.

REFERENCE SIGNS

1 Module
2 Fitting ring
3, 3' Key module
4 Actuator module
5 Connector piece
6 Actuation opening on the module
7 Switch module
8, 8' First transmission element
9 Command function module
10, 10' Second transmission element
11 Module housing
12, 12*a* Switching member
13, 13' Key-shaped actuator
14 Actuator
15 Actuator part
16 Actuator portion
17 Interference fit of a first transmission element
18 Direction of the arrow
19 Direction of the arrow
20 Direction of the arrow
21 Interference fit
22 Pivot axis
26 Switching protrusion
27 Wiggle room
28 Free space
29 Opening
30 Direction of the arrow
31 Direction of the arrow
33 Connection web
34 Direction of the arrow
36 Direction of the arrow
37 Groove-type interference fit
38 Connection web
39 Arm
40 Protrusion
41 Groove
42 Groove chamfer
43 Female plug
46 Electrical plug connector
47 Male plug
50 Push button
51 Terminal connector
52 T-shaped plug connector
53 Ramp-shaped sheet metal plate
54 Roller-lever switch
55 Signal lamp
56 Multicore cable
57 Difference in level
60 Available space
61 Action line of switching protrusions
63 Sensor region
64 Position sensor
65 Direction of the arrow
66 Centerline
67 Blocking piece
68 Rotating key cylinder
69 Drive shaft
70 Rotary disk
71 Entrainment opening
74 Dog
76 Direction of the arrow
77 Direction of the arrow
78 Direction of the arrow
79 Direction of the arrow
80 Direction of the arrow
81 Rotating key opening
100 Safety switch assembly
110 Actuation installation
120 Switch installation
130 Transmission installation
135 Transmission member
140 Gearbox part
145 Cam gear

The invention claimed is:

1. A safety switch assembly (100) comprising a switch installation (120) having at least one switching member (12, 12*a*), at least one actuation installation (110) having at least one assigned actuator (13, 13', 13", 14), a transmission installation (130) having at least one transmission member (135) which is coupleable or coupled to the switching member (12, 12*a*) and to the at least one actuator (13, 13', 13", 14) provided between the actuation installation (110) and the switch installation (120), the transmission installation (120) includes a plurality of separate transmission members (135) which during actuation of the at least one actuator (13, 13', 13", 14) of the actuation installation (110) are drivable or driven in a synchronous and mutually independent manner, and each of the transmission members (135) by way of a rotary movement converts an actuation movement of the at least one actuator (13, 13', 13", 14) to a translatory movement of a respective separate one of the switching members (12, 12*a*) of the switch installation (120).

2. The safety switch assembly (100) as claimed in claim 1, wherein the transmission members (135) of the transmission installation (130) are each provided with a plurality of transmission elements (8, 8', 10, 10').

3. The safety switch assembly (100) as claimed in claim 2, wherein at least two of the transmission elements (8, 8', 10, 10') of each of the respective transmission members (135) of the transmission installation (130) are interconnected in a rotationally fixed manner.

4. The safety switch assembly (100) as claimed in claim 2, wherein at least one of the transmission elements (8, 8', 10, 10') of each of the respective transmission members (135) is mounted so as to be pivotable about axes (22) that extend between housing walls (11) of a housing or part-housing of the safety switch assembly (100), said axes (22) being disposed so as to be mutually parallel.

5. The safety switch assembly as claimed in claim 2, wherein two of the transmission members (135) of the transmission installation (130) in the actuation of the actuator (13, 13', 13", 14) carry out a mutually opposing pivoting movement.

6. The safety switch assembly (100) as claimed in claim 1, wherein the at least one actuator (13, 13', 13", 14) of the actuation installation (110) when actuated carries out a translatory or a rotary movement.

7. The safety switch assembly (100) as claimed in claim 1, wherein the at least one actuator (13, 13', 13", 14) of the actuation installation (110) has at least one gearbox part (140) which is operatively connected to at least one first transmission element (8, 8') of one of the transmission members (135) of the transmission installation (130).

8. The safety switch assembly (100) as claimed in claim 7, wherein the gearbox part (140) is configured as an actuator portion (16) that is disposed in a region of a free end of the actuator (13, 13', 13", 14), or as a cam gear (145).

9. The safety switch assembly (100) as claimed in claim 8, wherein the cam gear (145) transmits a rotary movement of the actuator (13") to the transmission members (135).

10. The safety switch assembly (100) as claimed in claim 8, wherein the cam gear (145) is configured having at least one dog (74) that engages in a respective entrainment opening (71), or is configured having at least one gear drive.

11. The safety switch assembly (100) as claimed in claim 7, wherein the first transmission element (8) of the transmission members (135) is configured in a roller-type manner and having a cross section that is curved so as to be approximately crescent-shaped.

12. The safety switch assembly (100) as claimed in claim 1, wherein first transmission elements (8, 8') of various ones of the transmission members (135) have a mutual offset in a direction of actuation of the actuator (13, 13', 13", 14).

13. The safety switch assembly (100) as claimed in claim 1, wherein a first transmission element (8) of the transmission members (135) has an interference fit (17) in which one actuator portion (16) of the actuator (13, 13', 13", 14) is introducible, with an introduction thereof into the interference fit (17) or retrieval thereof from the interference fit causing a rotary movement of the transmission element (8, 8').

14. The safety switch assembly (100) as claimed in claim 13, wherein actuation portions (16) of the actuator (13, 13', 13", 14) that are provided for engaging in the interference fit (17) of first transmission elements (8, 8') have a shape that is complementary to a cross-section of the first transmission element (8, 8').

15. The safety switch assembly (100) as claimed in claim 13, wherein faces of the first transmission element (8, 8') and of an assigned actuation portion (16) of the respective actuator (13, 13', 13", 14) that in a closed position are mutually facing are provided with a mutually matching coding.

16. The safety switch assembly (100) as claimed in claim 13, wherein a second transmission element (10, 10') of at least one of the transmission members (135) that is connected to the first transmission element (8, 8') is provided as an eccentric which engages in an interference fit (21) of the switching member (12 12*a*) assigned to said second transmission element.

17. The safety switch assembly (100) as claimed in claim 1, wherein the switch installation (120) and the actuation installation (110) are configured separately or collectively as modules and have connectors for releasably connecting to one another, and the switching members (12, 12*a*) in the assembly position are aligned and by way of switching are releasably connectable to one another.

18. The safety switch assembly (100) as claimed in claim 1, wherein the switching members (12, 12*a*) are configured as planar plate-shaped switching pieces which in the translatory movement of the switching pieces are guided in at least one guide on the safety switch assembly (100).

19. The safety switch assembly (100) as claimed in claim 18, wherein the at least one guide is provided in a wall-proximate region of a housing wall (11) of a module (1, 3, 3', 3", 4, 7, 9) such that the switching members (12, 12*a*) are oriented so as to be substantially parallel with the housing wall (11) and to be movable along the housing wall.

20. The safety switch assembly (100) as claimed in claim 1, wherein the switching members (12, 12*a*) on at least one end thereof in a direction of movement have at least one switching element in order for a connection to the switching elements of a switching member (12, 12*a*) that is neighboring in a direction of movement to be established or severed.

21. The safety switch assembly (100) as claimed in claim 20, wherein the switching elements are configured as switching protrusions (26) which from the respective switching elements protrude substantially in a direction of the switching member (12, 12*a*) that is neighboring in the direction of movement.

22. The safety switch assembly (100) as claimed in claim 1, further comprising a sensor installation having at least one position sensor (64) disposed between two of the switching members (12, 12*a*) of the switch installation (120) that are disposed so as to be mutually parallel, said sensor installation determining a mutual relative position of the two switching members (12, 12*a*).

23. The safety switch assembly (100) as claimed in claim 22, wherein the position sensor (64) in a linear manner connects two sensor regions (63) that are disposed in a mirror-image manner in relation to an imaginary central plane between the switching members (12, 12*a*).

24. The safety switch assembly (100) as claimed in claim 23, wherein the position sensor (64) is provided with a connection web (33) that extends between the sensor regions (63) and is connected to said sensor regions in an articulated manner, and at least one blocking element.

25. The safety switch assembly (100) as claimed in claim 24, wherein the at least one blocking element is formed by arms (39) that project from the connection web (33) substantially in a direction of the connection or transversely thereto.

26. The safety switch assembly (100) as claimed in claim 25, wherein the at least one blocking element of the position sensor (64) in a modification of the mutual relative position of the switching members (12, 12*a*) moves to an interference fit with an assigned blocking piece (67).

27. The safety switch assembly (100) as claimed in claim 26, wherein the blocking piece (67) is disposed on at least one housing wall (11) of a respective module (1, 3, 3', 3", 4, 7, 9), said at least one housing wall (11) being neighboring to the switching members (12, 12*a*) or extending between the switching members (12, 12*a*).

28. The safety switch assembly (100) as claimed in claim 26, wherein the blocking piece (67) is formed by a plurality of groove-type interference fits (37) that in a direction of actuation of the switching members (12, 12*a*) are disposed beside one another so as to be mutually adjacent.

29. The safety switch assembly (100) as claimed in claim 1, wherein an available space (60) that is free of at least one of movable or moving transmission or switching members (12, 12*a*) and extends in a contiguous manner across an entire longitudinal extent of a module (1, 3, 3', 3", 4, 7, 9) running in a direction of movement of the switching members (12, 12*a*) is provided between two opposite ones of the switching members (12, 12*a*) of the module (1, 3, 3', 3", 4, 7, 9) that are disposed so as to be mutually spaced apart.

30. The safety switch assembly (100) as claimed in claim 29, wherein a contiguous space (60) is disposed about a central longitudinal axis (66) of the module (1, 3, 3', 3", 4, 7, 9) that is located between the two switching members (12, 12*a*).

31. The safety switch assembly (100) as claimed in claim 29, wherein at least one of an electrical or electronic signal transmission installation is disposable or disposed in the available space (60) that is located between the switching members (12, 12*a*) of the module (1, 3, 3', 3", 4, 7, 9).

32. The safety switch assembly (100) as claimed in claim 1, wherein a plurality of modules (1, 3, 3', 3", 4, 7, 9) of the safety switch assembly (100) are provided with connectors which are configured for assembly in various rotary positions of the modules (1, 3, 3', 3", 4, 7, 9).

33. The safety switch assembly (100) as claimed in claim 32, wherein the modules (1, 3, 3', 3", 4, 7, 9) have moldings on ends (44, 45) thereof that engage in one another in a form-fitting manner, and a protrusion that deviates from a round shape provided on one of the modules (1, 3, 3', 3", 4, 7, 9), and a depression that is complementary to the protrusion is provided on another one of the modules (1, 3, 3', 3", 4, 7, 9) to be coupled.

34. The safety switch assembly (100) as claimed in claim 1, wherein the switching member (12, 12*a*) is forcibly guided by the at least one transmission member (135), and a transmission element (10, 10') of the at least one transmission member (135) that forcibly guides the switching member (12, 12*a*) is configured as an eccentric.

35. A key transfer switching system having a safety switch assembly (100) as claimed in claim 1.

* * * * *